US007594826B2

(12) United States Patent
Kobayashi et al.

(10) Patent No.: US 7,594,826 B2
(45) Date of Patent: Sep. 29, 2009

(54) CONNECTOR

(75) Inventors: Mitsuru Kobayashi, Shinagawa (JP); Yasuyuki Miki, Shinagawa (JP); Hideo Miyazawa, Shinagawa (JP); Junichi Akama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/334,571

(22) Filed: Dec. 15, 2008

(65) Prior Publication Data

US 2009/0221164 A1 Sep. 3, 2009

(51) Int. Cl.
*H01R 13/648* (2006.01)

(52) U.S. Cl. ..... 439/607.07; 439/108

(58) Field of Classification Search ..... 439/607.05–607.14, 108
See application file for complete search history.

(56) References Cited

U.S. PATENT DOCUMENTS

| | | | | |
|---|---|---|---|---|
| 5,040,998 | A * | 8/1991 | Suzuki et al. | 439/79 |
| 5,121,127 | A * | 6/1992 | Toriyama | 343/700 MS |
| 5,438,697 | A * | 8/1995 | Fowler et al. | 455/347 |
| 6,517,360 | B1 | 2/2003 | Cohen | |
| 7,172,461 | B2 * | 2/2007 | Davis et al. | 439/607.11 |
| 7,371,117 | B2 * | 5/2008 | Gailus | 439/607.08 |
| 7,416,447 | B1 * | 8/2008 | Chen | 439/607.05 |
| 7,494,379 | B2 * | 2/2009 | Do et al. | 439/607.05 |
| 2006/0061433 | A1 * | 3/2006 | Matsumoto | 333/33 |
| 2007/0155241 | A1 * | 7/2007 | Lappohn | 439/608 |
| 2009/0017681 | A1 * | 1/2009 | Amleshi et al. | 439/608 |

FOREIGN PATENT DOCUMENTS

| | | |
|---|---|---|
| JP | 2003-522386 | 7/2003 |

* cited by examiner

*Primary Examiner*—Gary F. Paumen
(74) *Attorney, Agent, or Firm*—IPUSA, PLLC

(57) ABSTRACT

A connector includes a housing and a plurality of contact module assemblies in the housing, wherein each contact module assembly includes a first signal contact module where a first signal contact body is inserted in a first resin molded part, a second signal contact module where a second signal contact body is inserted in a second resin molded part, and a ground plate, wherein the ground plate is sandwiched between the first signal contact module and the second signal contact module, so that a microstrip line structure is formed, and wherein, in the microstrip line structure, the first signal contact body and the second signal contact body form a stripline conductor, the first resin molded part and the second resin molded part form a dielectric board, and the ground plate forms a common ground conductor.

11 Claims, 24 Drawing Sheets

(A)
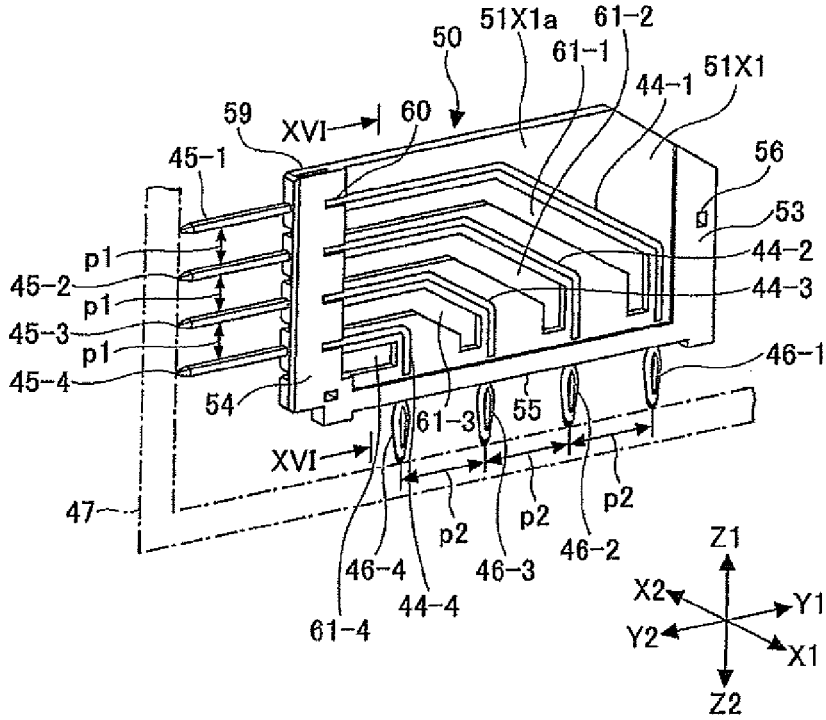
FIG.15
(B)
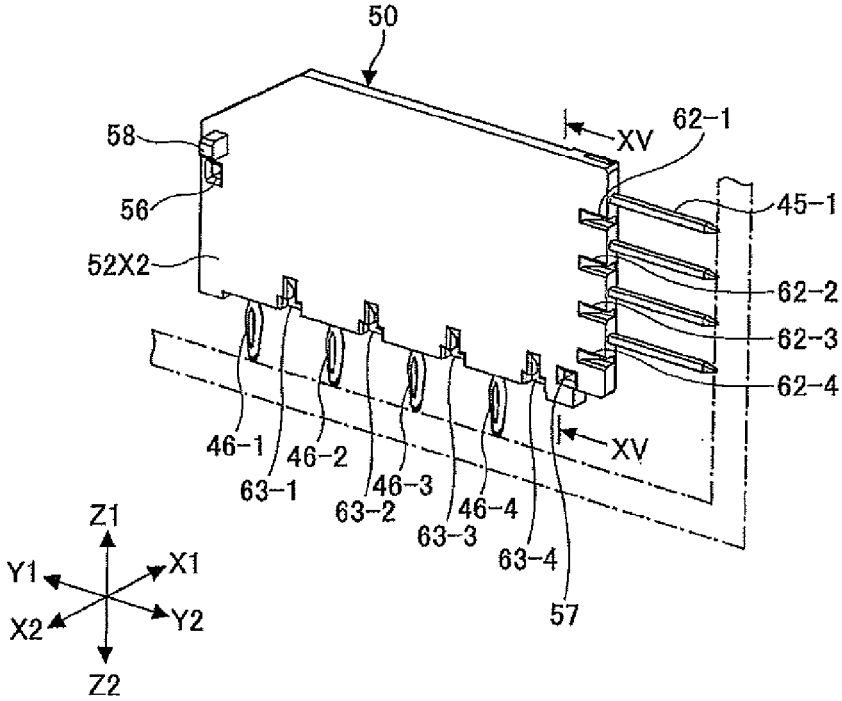

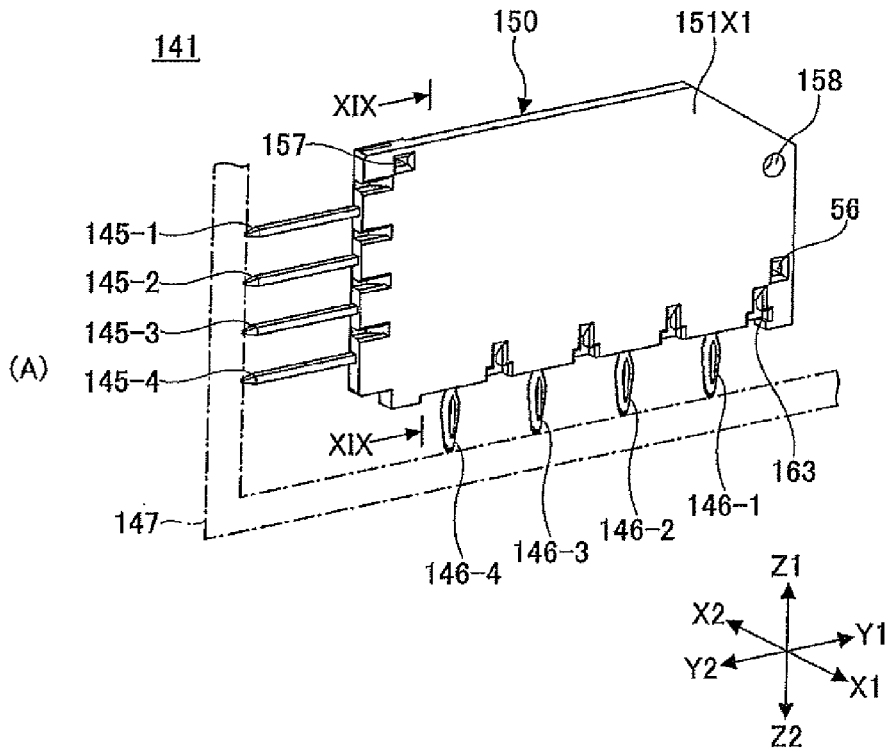
FIG.18
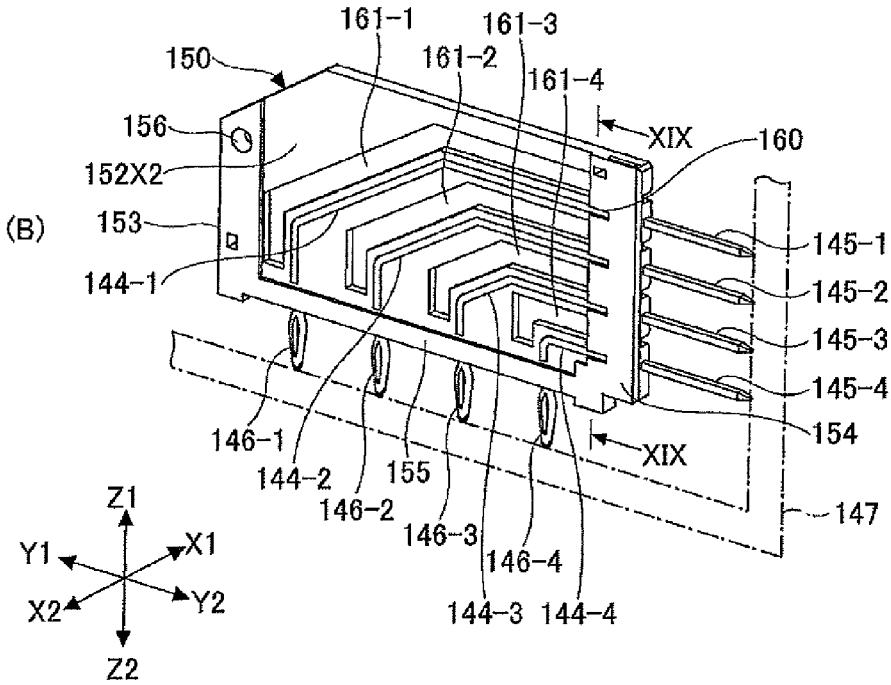

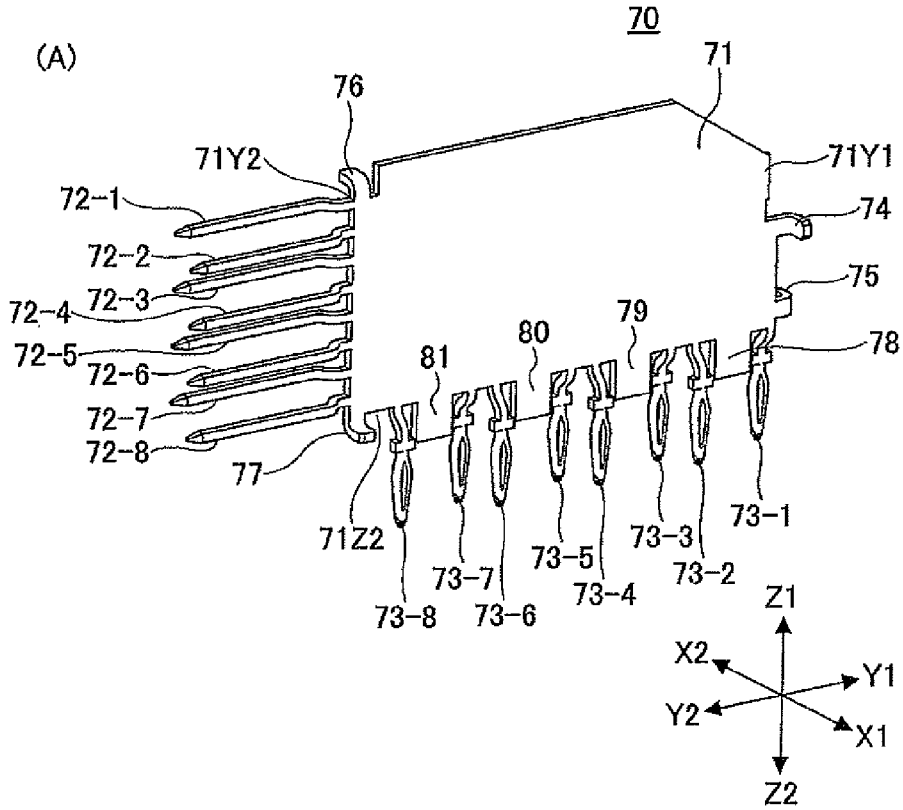
FIG.21
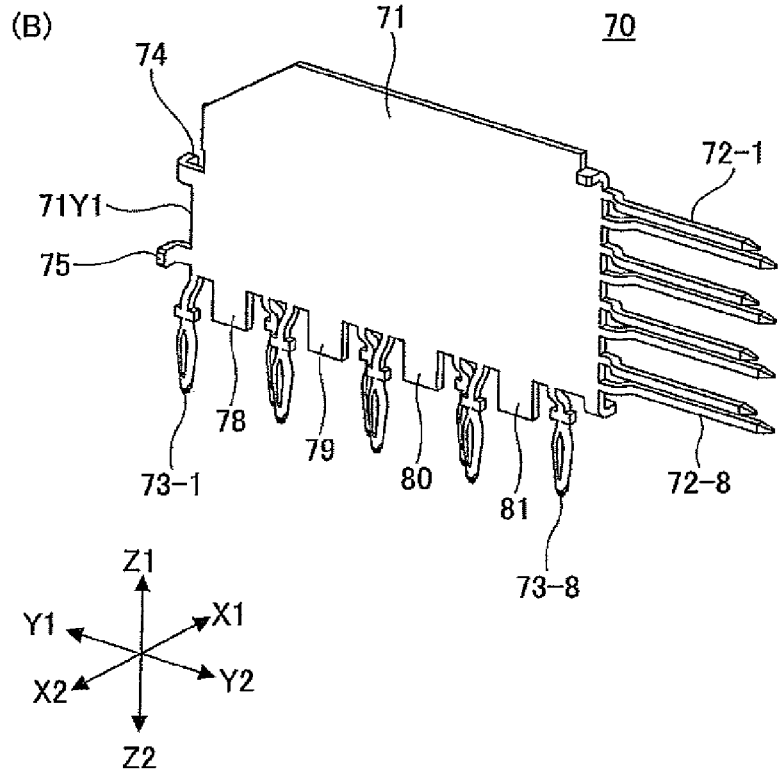

CONNECTOR

BACKGROUND OF THE INVENTION

1. Field of the Invention

The present invention generally relates to a connector, and more specifically, to a right angle type socket connector which is used for high speed transmission to electrically connect a cable with a print wired substrate for a communication apparatus or the like.

2. Description of the Related Art

Conventionally, a communication apparatus includes a print wiring substrate in it, on which is mounted a right angle type socket connector at an edge of the print wiring substrate. A socket part of the right angle type socket connector is configured to stick out from an opening of a panel of the communication apparatus. The communication apparatus is used with a condition in which the plug of a cable end is connected to the right angle type socket connector.

The right angle type socket connector includes numerous contact parts which project in the front side and are arrayed vertically and horizontally, and includes numerous terminal parts which project and are arranged vertically and horizontally.

The contact part is where the arrayed contacts of the plug are connected. The terminal part includes arrayed terminals which are connected to the terminals of the print wiring substrate by solder or press-fitting. The contact part and the terminal part are arranged at a right angle from a side view of the socket connector.

In recent these years, with an increasing capacity of signal transmission, communication systems are required to increase the transmission speed of signals and place shields between signals to be transmitted. It is also required to increase the impedance of signal transmission lines.

As a socket connector forms part of the signal transmission lines, the shielding of individual signals, which signals propagate along the transmission lines of signal contacts, is required to increase the impedance of individual signal transmission lines for socket connectors.

For example, a conventional socket connector includes plural contact module assemblies. The individual assemblies have mounted a print wiring substrate with a small size and approximately rectangular shape. The contact module assemblies are configured to face each other. Signal transmission lines are formed on a print wiring substrate as a pattern, and it is possible to increase shielding characteristics of signals and impedance of the signal transmission lines with a suitable design of a print wiring substrate.

In addition to the print wiring substrate, the contact module assembly needs to provide a contact part arranged by plural contact parts and a terminal part including terminal elements, and those are respectively fixed on individual sides of the print wiring substrate by soldering. Further, the module needs a cleaning treatment and inspection of the condition of the module after soldering. Thus, such a contact module assembly needs process steps for construction.

Further, in FIG. 1, FIG. 2A, and FIG. 2B in Japanese Published Patent Application 2003-522386, it is shown that a first half wafer and a second half wafer are stacked to form a unit wafer, and plural unit wafers are placed to face each other and arranged in a socket. The first half wafer has an approximate shape of a small piece of a half plate which is configured by a first signal element and a ground connection element by insert molding. The second half wafer has an approximate shape of a small piece of half plate which is configured by insert molding. The fabrication process of the socket connector is easier than that of the print wiring substrate described above.

Patent document 1 Japanese Published Patent Application 2003-522386.

The following are issues. A wafer includes a first signal element and a second signal element facing each other, and a ground element having a line shape arranged between adjacent first elements. Thereby, it is difficult for the ground element to shield the first element and the second element.

Further, both the first and second elements are entirely surrounded by resin, and increasing its impedance is difficult. Further, the first and second elements are not formed to have microstrip line structures, which make it difficult to design the impedance for fitting a specification of a connector.

One aspect of the present invention may provide a connector for reducing the issues above.

SUMMARY OF THE INVENTION

Accordingly, embodiments of the present invention may provide a novel and useful apparatus and method solving one or more of the problems discussed above.

More specifically, the embodiments of the present invention may provide a connector including a housing and a plurality of contact module assemblies in the housing, wherein each contact module assembly includes: a first signal contact module where a first signal contact body is inserted in a first resin molded part; a second signal contact module where a second signal contact body is inserted in a second resin molded part, and a ground plate, wherein the ground plate is sandwiched by the first signal contact module and the second signal contact module, so that a microstrip line structure is formed, and wherein, in the microstrip line structure, the first signal contact body and the second signal contact body form a stripline conductor, the first resin molded part and the second resin molded part form a dielectric board, and the ground plate forms a common ground conductor.

According to one aspect of the present invention, there are several effects as follows.

(1) The connector has an assembled structure and includes a microstripe line structure. A first signal contact and a second signal contact form a signal transmission line, so that the impedance of the signal transmission line is easy to design for adapting for a specification of the connector.

(2) A ground plate is sandwiched between the first signal contact and the second signal contact, which improves the signal-shielding effect between the first signal contact and the second signal contact.

(3) The effects of paragraphs (1) and (2) provide high speed signal transmission.

(4) A contact module assembly is configured by placing a ground plate between a first signal contact module and a second signal contact module, which provides easy construction.

(5) A ground plate is configured as a common ground conductor; thus, only a single ground plate may be used, so that the number of parts may be reduced.

Other objects, features, and advantages of the present invention will become more apparent from the following detailed description when read in conjunction with the accompanying drawings.

BRIEF DESCRIPTION OF THE DRAWINGS

FIG. 15 shows a perspective view of a first signal contact insert molding module;

FIG. 18 shows a perspective view of a second signal contact insert molding module;

FIG. 21 shows a ground plate;

DETAILED DESCRIPTION OF THE PREFERRED EMBODIMENTS

Embodiments of the present invention is described below, with reference to FIG. 1 through FIG. 24.

Embodiment 1

Figure 1:
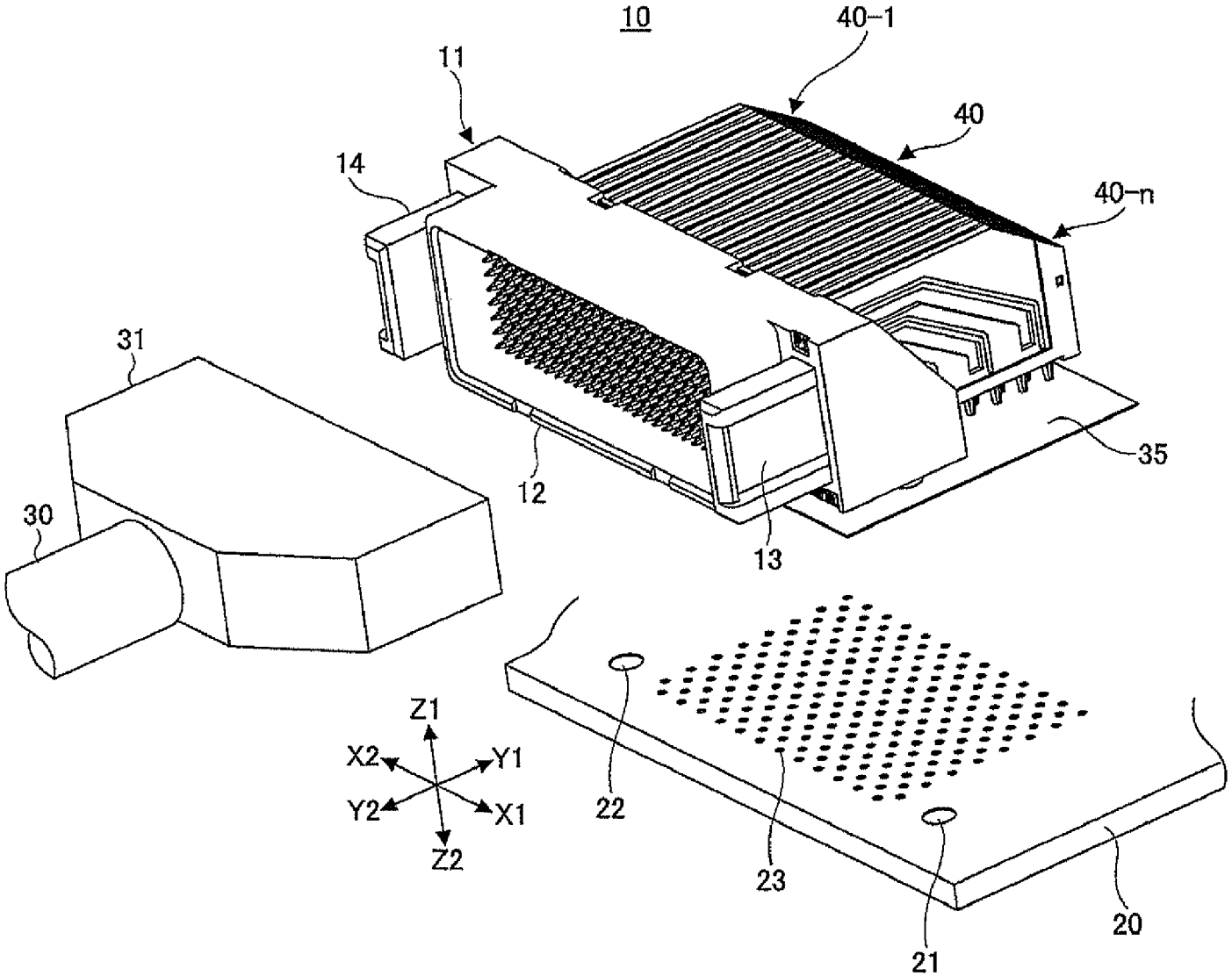
FIG. 1 is a perspective diagram showing a socket connector according to a first embodiment of the present invention, a print wiring substrate for mounting the socket, and a connector of a cable end to insert and connect the socket.
Figure 2:
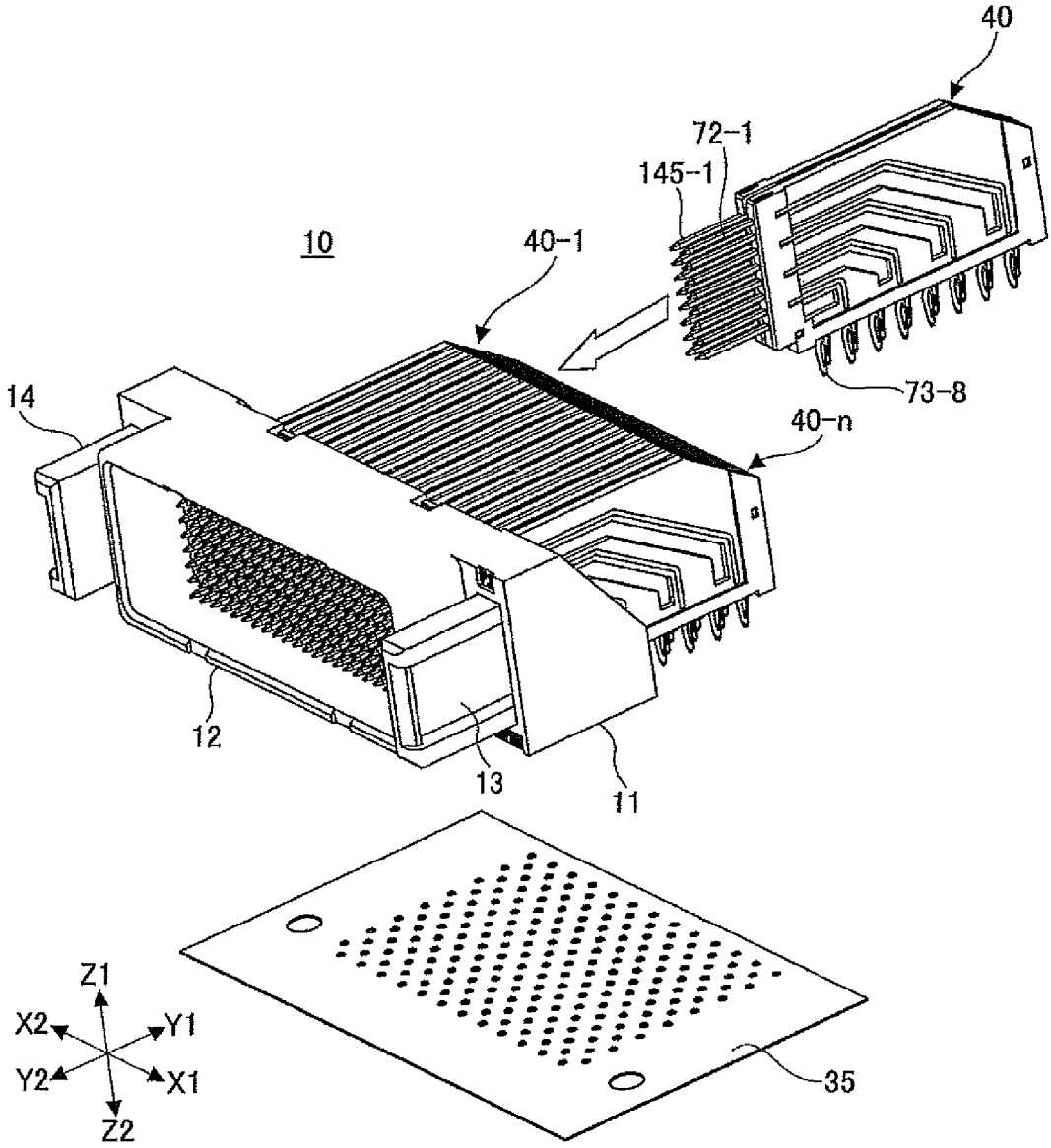
FIG. 2 shows a perspective diagram of the socket connector of FIG. 1 separated into parts.

FIG. 1 shows a perspective diagram of a socket connector 10 according to a first embodiment of the present invention, corresponding to a print wiring substrate 20 on which to mount the connector 10, and a cable connector 31 of an end of a cable 30 to insert in and connect to the connector 10. FIG. 2 shows the connector 10 in an exploded perspective view. The connector 10 is a right angle type which is suitable for single transmission.

X1-X2, Y1-Y2, and Z1-Z2 indicate the directions in width, length, respectively, and height of the connector 10. Y2 indicates the front, and Y1 indicates the back.

Figure 3:
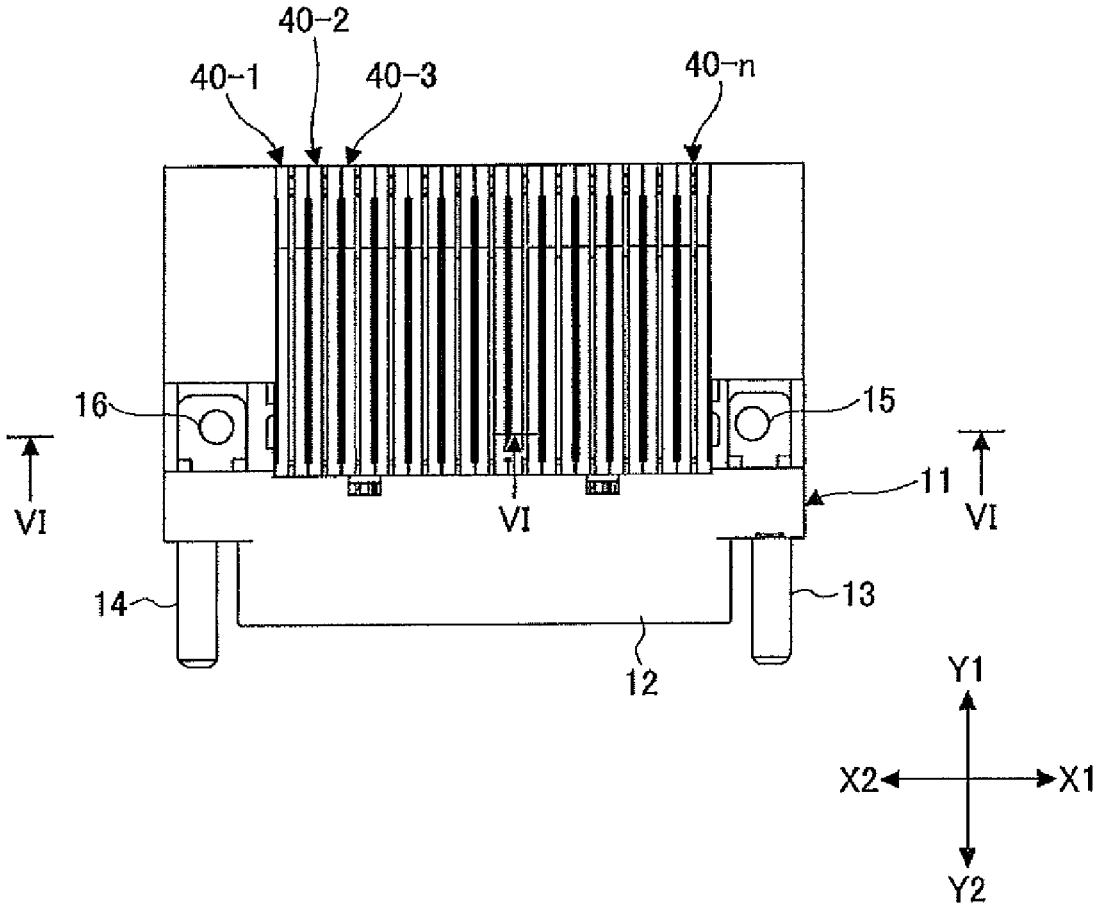
FIG. 3 is a plan view of the socket connector.
Figure 4:
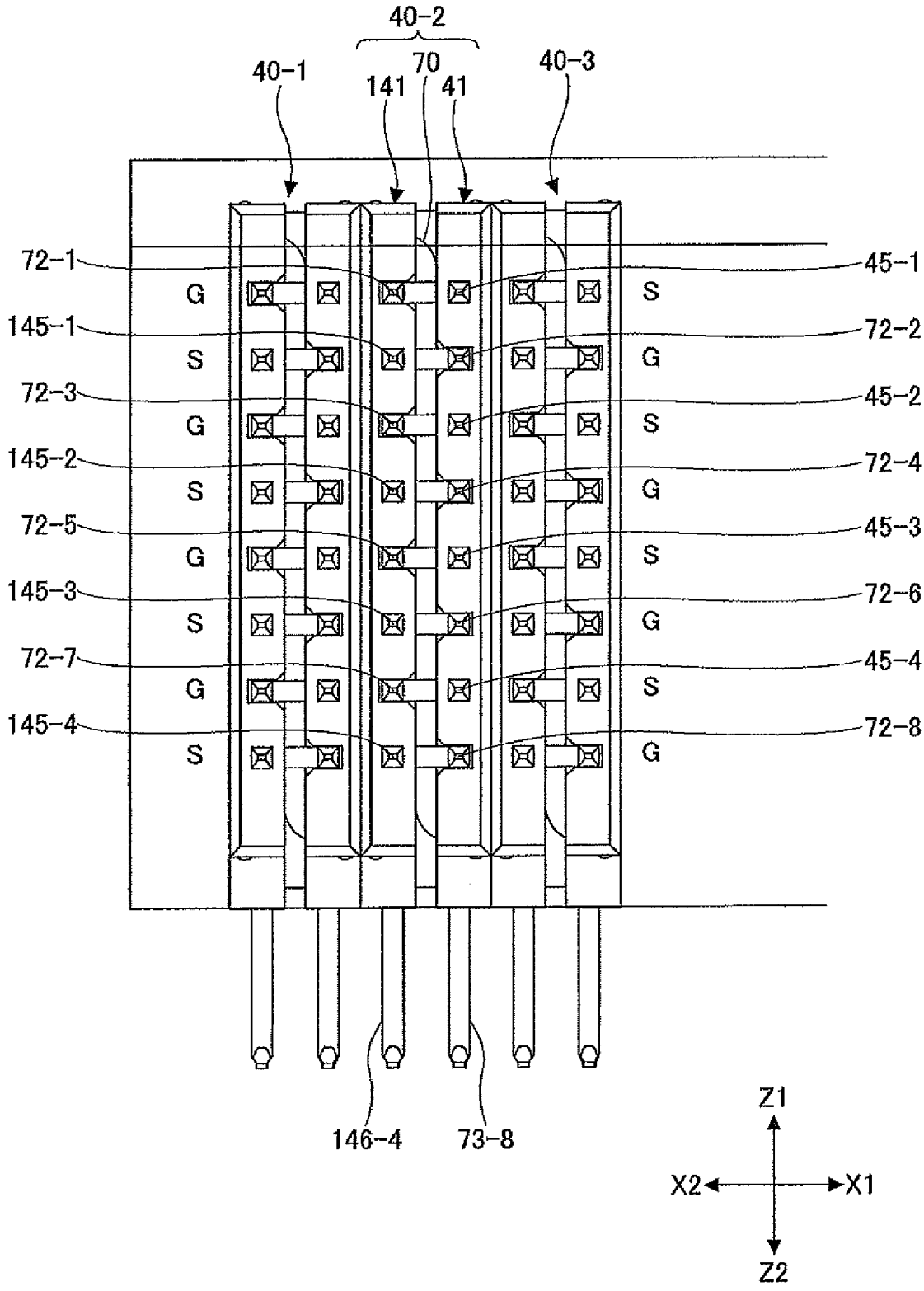
FIG. 4 is an illustration showing an enlarged front view of a socket connector and contact module assemblies arranged in the socket.
Figure 5:
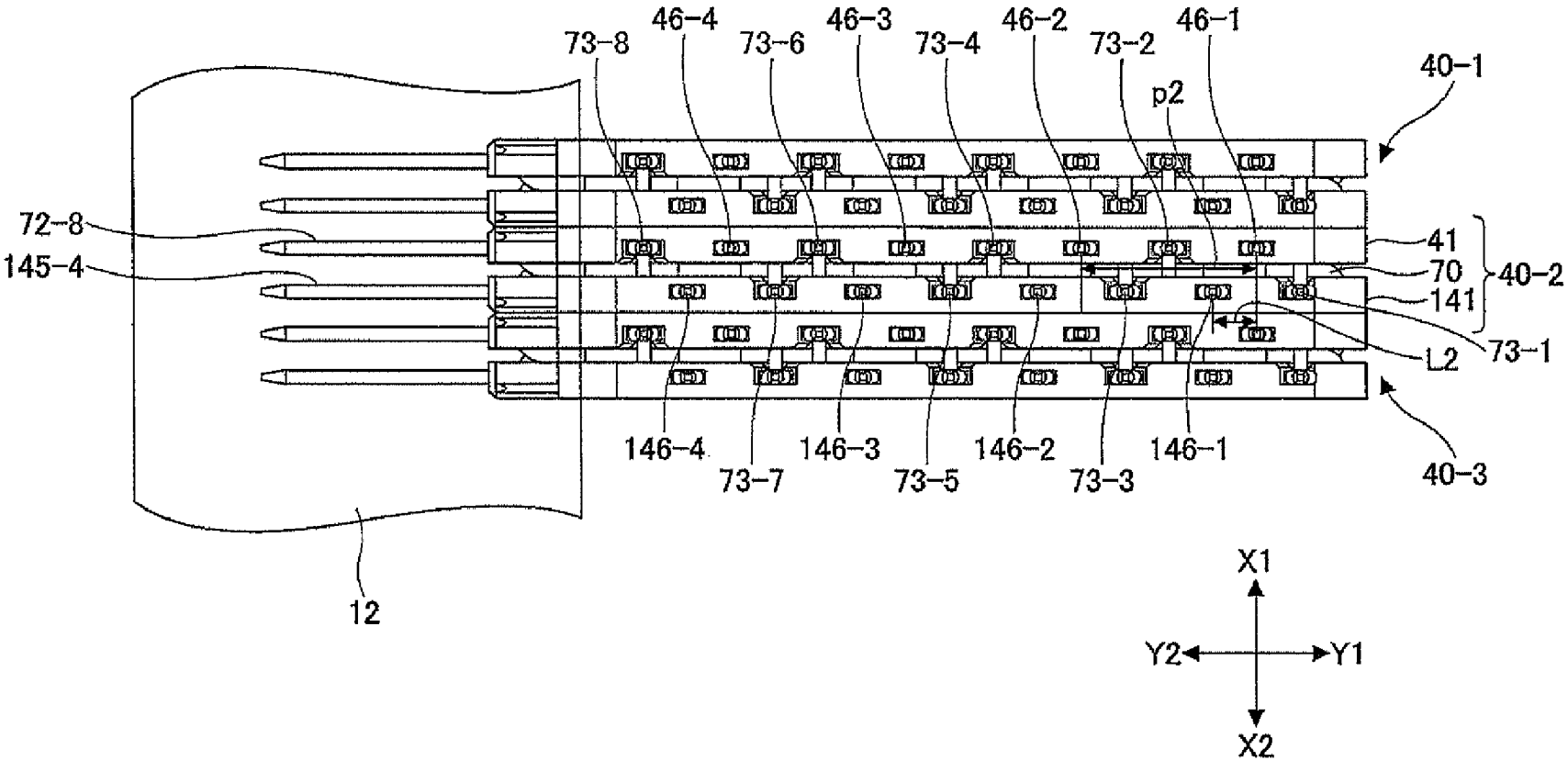
FIG. 5 is an illustration showing an enlarged bottom view of a socket connector and contact module assemblies being arranged in the socket.
Figure 6:
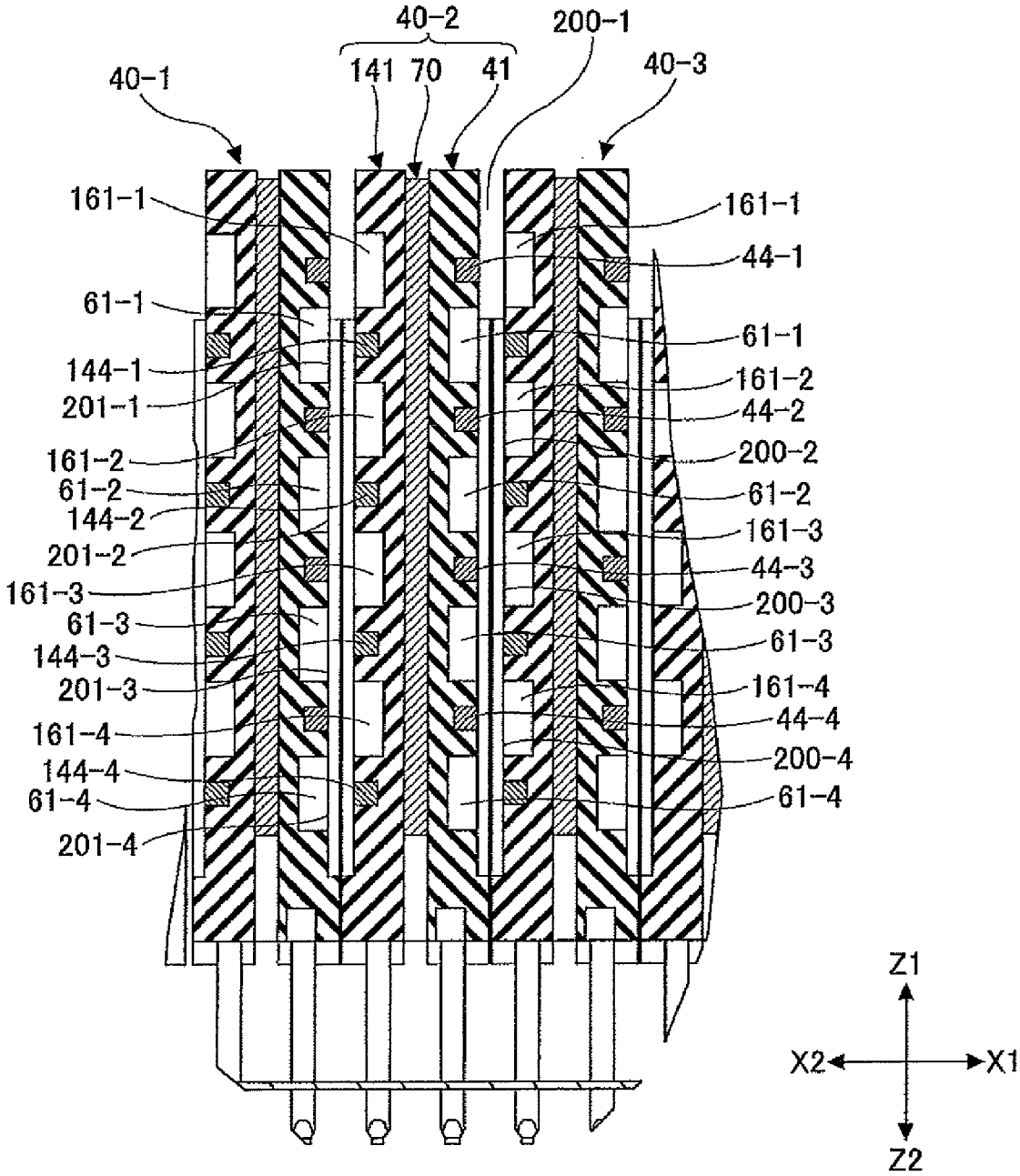
FIG. 6 shows an enlarged cross-sectional view of a connector including contact module assemblies arranged in view from a line VI-VI of FIG. 3.

FIG. 3 shows a plan view of the socket connector 10. FIG. 4 shows a front view of the socket 10, and FIG. 5 is a bottom view of the connector 10. FIG. 6 shows a cross-sectional view of the connector 10 along the line VI-VI in FIG. 3.

For all figures, some signs for crowded parts are omitted. Plural identical parts are indicated with branch numbers.

Further, when an entire part is indicated for unspecified identical individual parts in the present specification, reference numbers and letters with no branch number are used.

The connector 10 includes a contact module assembly 40 tightly inserted in a housing 11 from the Y1 side and plural (number n) contact module assemblies 40-1 through **40-*n* are arranged in X1-X2 direction facing each other. A shield cover (not shown) covers a projection part of the contact module assembly 40, which projects from the housing 11 to the Y1 side, and an arrangement sheet 35**.

The housing 11 is a resin molded part. The housing 11 includes a rectangular frame 12 in the X1-X2 direction. Ratchet arms 13 and 14 project from corresponding sides of the frame 12 in the Y2 direction. Bosses 15 and 16 (see FIG. 3) project from corresponding sides of the frame 12 in the Z2 direction.

The front of the connector 10, in the frame 12, is provided with first and second signal contact parts 45, 145, and ground contacts 72, which are arranged as a matrix by a staggered arrangement in the X-Z plane as shown in FIG. 4. On the bottom of the connector 10, there are first and second signal terminal parts 46, 146 (signal terminal parts 46,146), and ground terminals 73, having press-fit structures, with a staggered arrangement as a matrix in the X-Y plane, as shown in FIG. 5. The arrangement sheet 35 includes the first and second signal terminal parts 46, 146, and the ground terminals 73 which are tightly bound on the sheet 35 to be arranged as a matrix shape.

The bosses 15 and 16 (see FIG. 3) of the connector 10 are fitted into holes 21 and 22 (see FIG. 1) of the print wiring substrate 20 for positioning, with a position of detaching the arrangement sheet 35, and the signal terminal parts 46-1, 146-1, and the like, and the ground terminal 73-1 and the like are press fit into terminal holes 23 of the print wiring substrate 20 to mount the connector 10 on the print wiring substrate 20 and fixed without soldering.

[Schematic Diagram of Contact Module Assembly 40 Structure]

FIG. 7(A) is a perspective schematic diagram of the contact module assembly 40 viewed from the X1 side, also showing its exploded view. FIG. 7(B) is a perspective schematic diagram of the contact module assembly 40 viewed from the X2 side. FIG. 8 shows a projection-drawing of the contact module assembly 40.

FIG. 8 shows an orthographic projection of FIG. 8(B).

Figure 10:
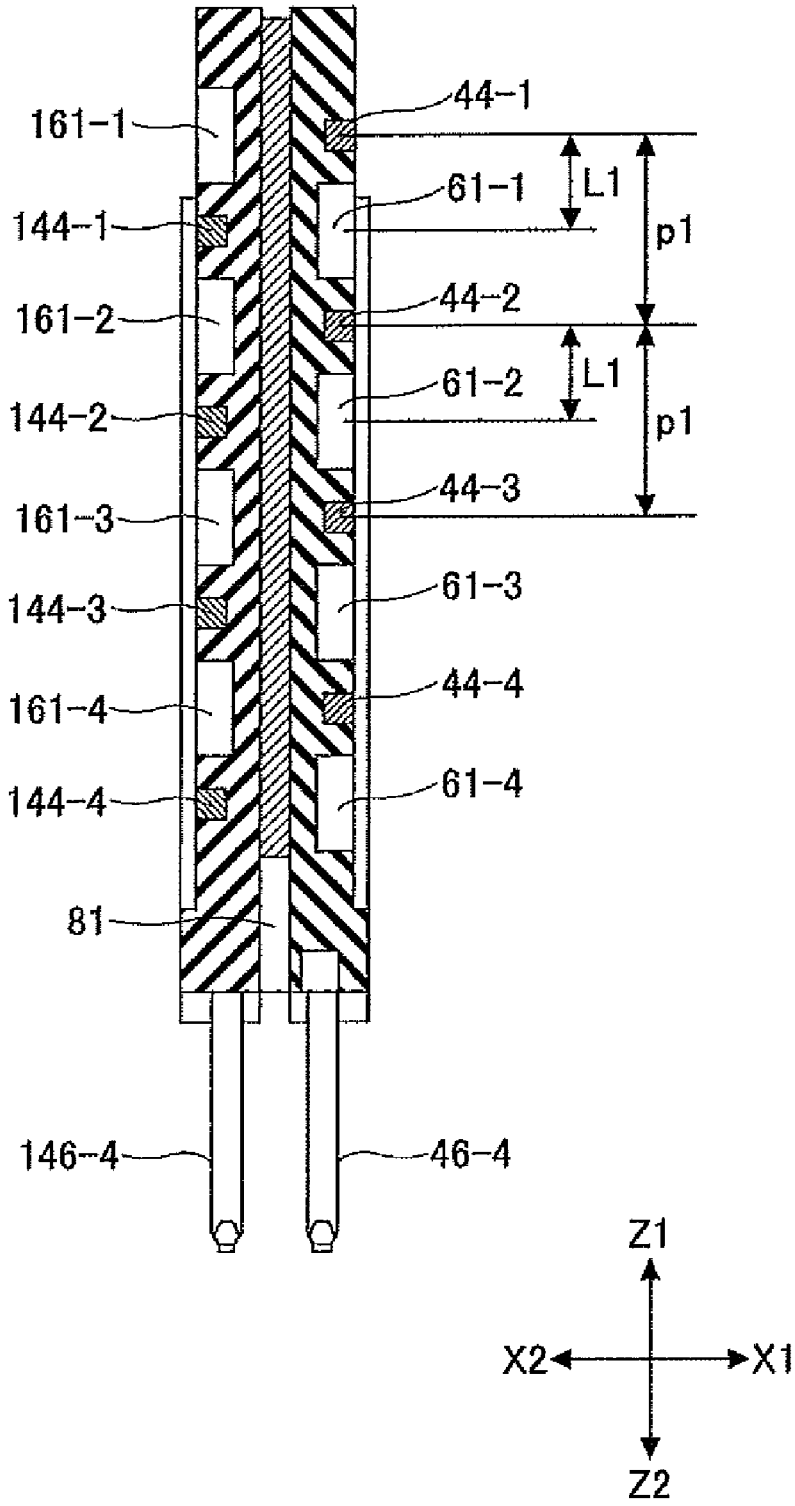
FIG. 10 shows an enlarged cross-sectional view of the connector along a line X-X of FIG. 8(A)
Figure 11:
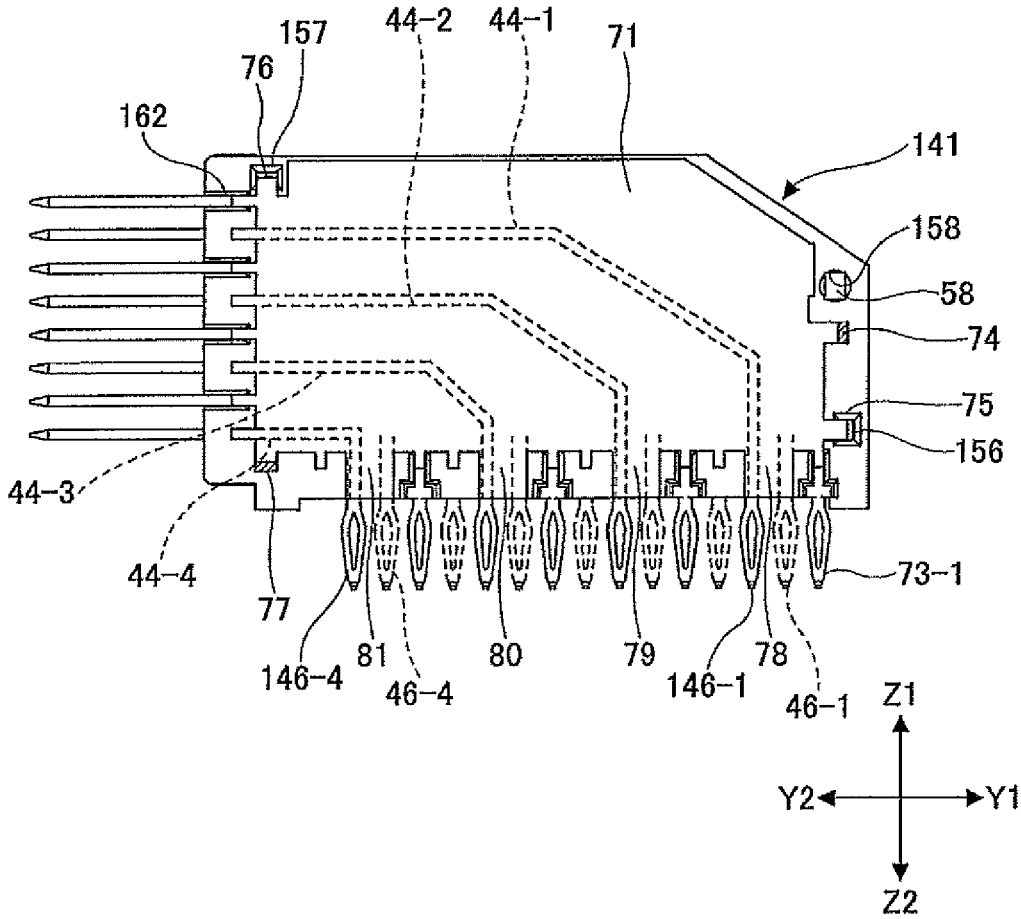
FIG. 11 shows an enlarged cross-sectional view of the contact module of FIG. 8(B) in view along a line XI-XI.
Figure 12:
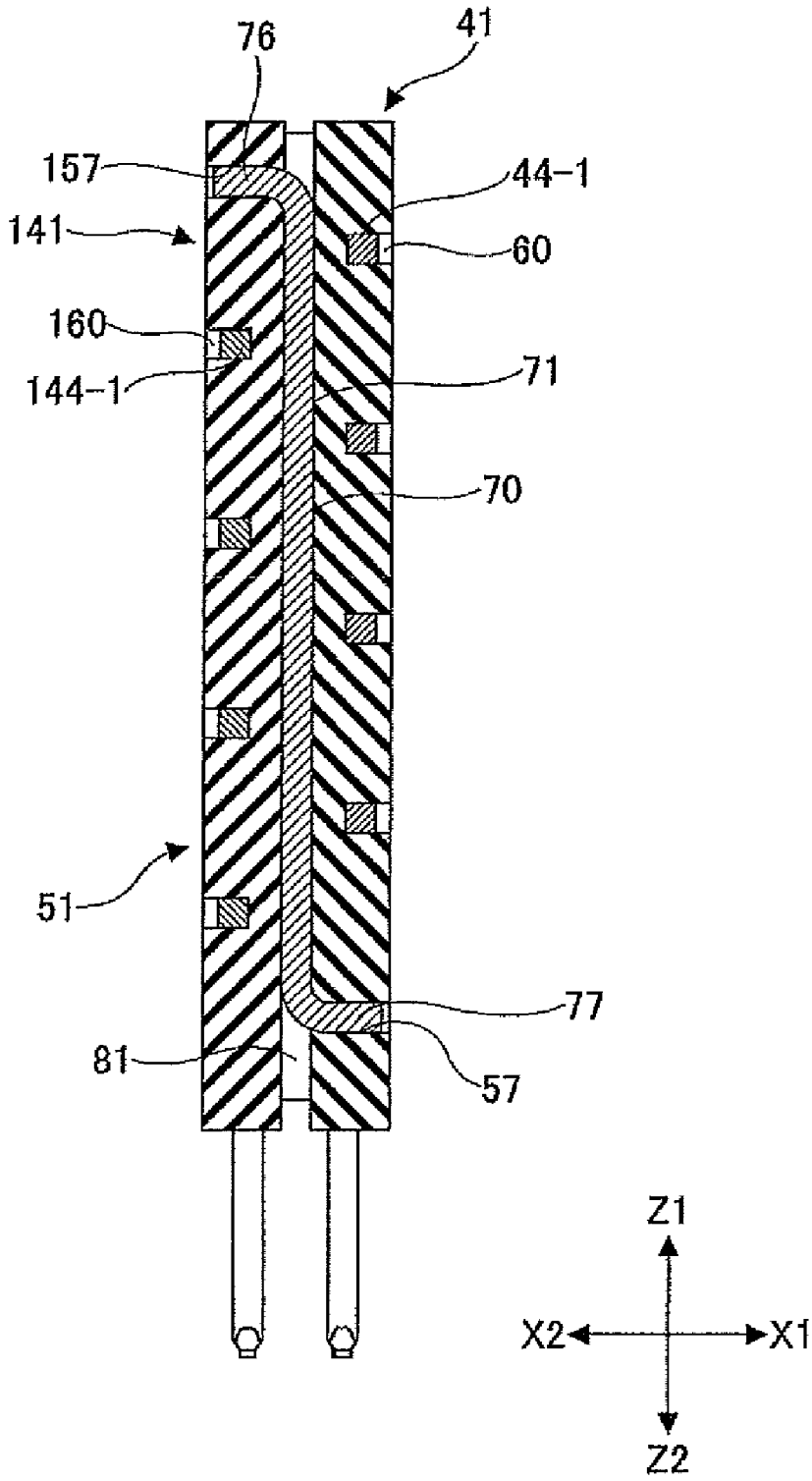
FIG. 12 shows an enlarged cross-sectional view of the contact module of FIG. 8(A) in view along a line XII-XII.
Figure 13:
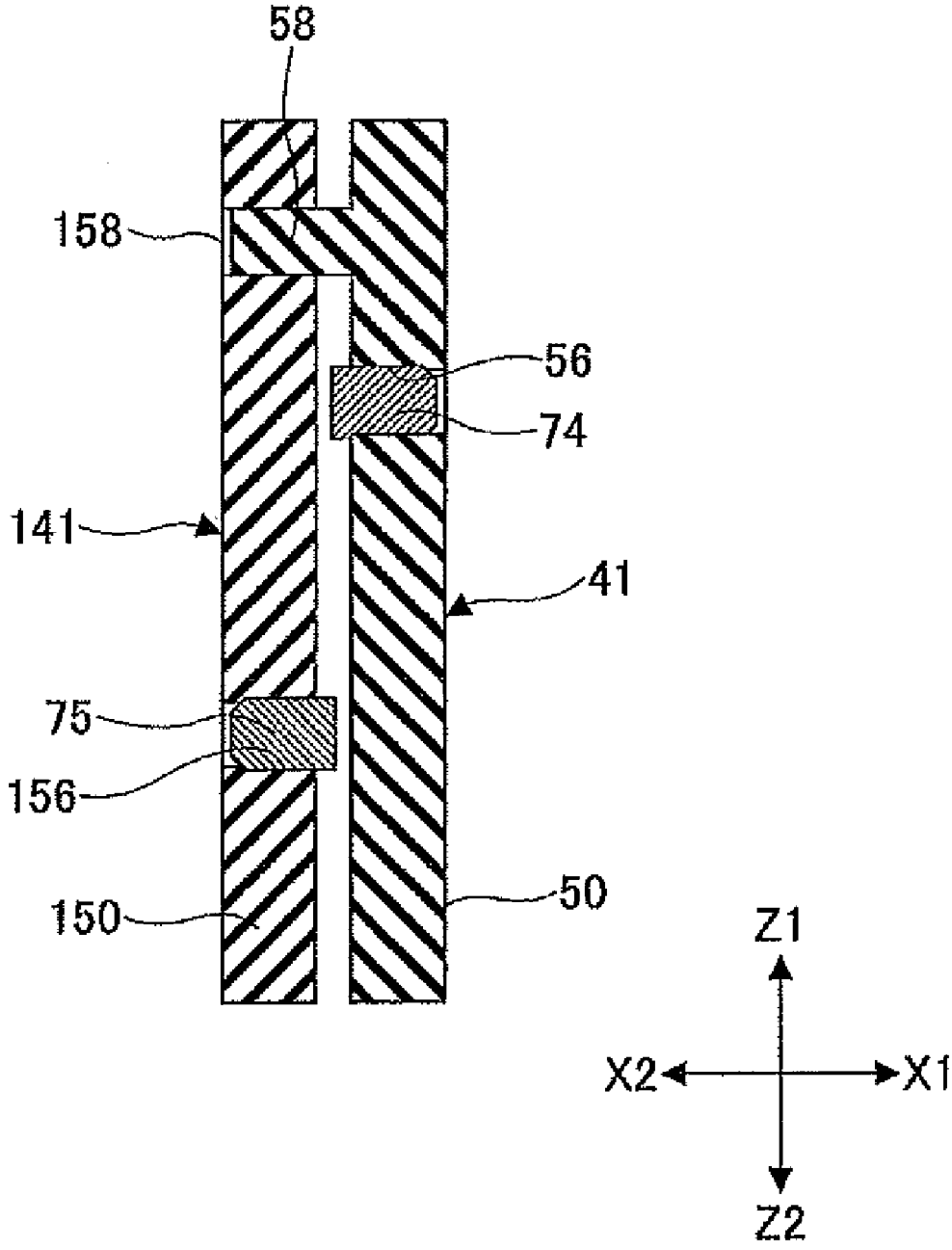
FIG. 13 shows an enlarged cross-sectional view of the contact module of FIG. 8(A) in view along a line XIII-XIII.
Figure 14:
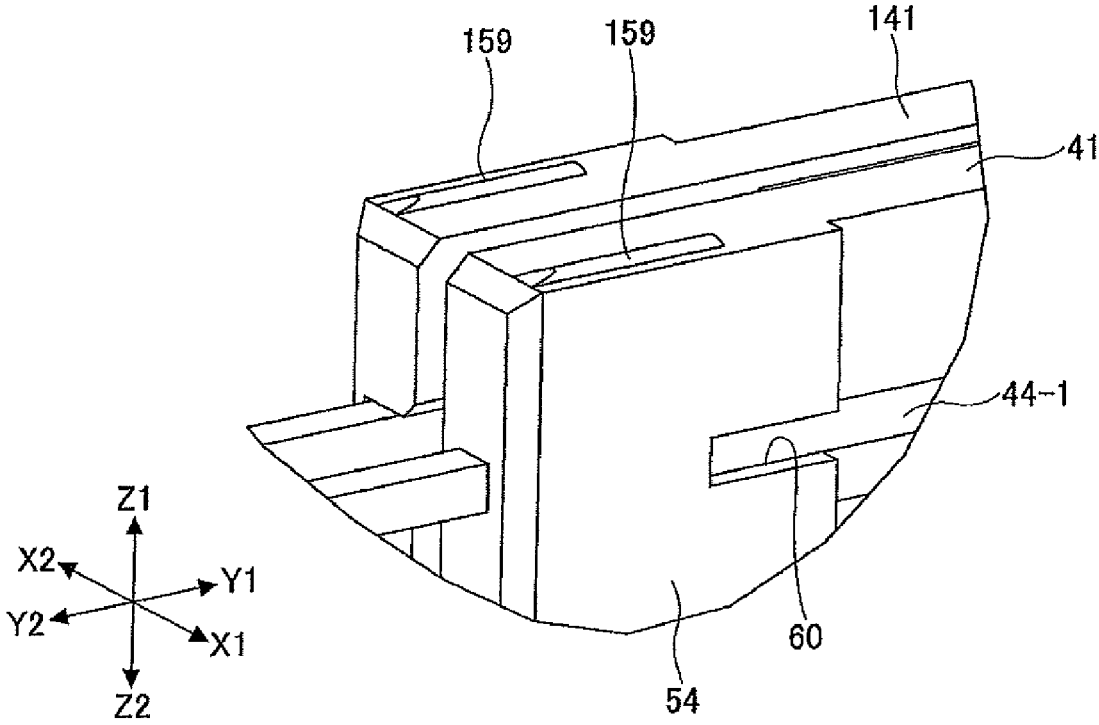
FIG. 14 shows an enlarged perspective view of the contact module in view of the circle indicated in FIG. 7(A)

FIG. 10 is an enlarged cross-sectional diagram of FIG. 8(A) taken along line X-X. FIG. 11 is an enlarged cross-sectional diagram of FIG. 8(B) taken along line XI-XI, and FIG. 12 is an enlarged cross-sectional diagram of FIG. 8(A) in view of a line XII-XII. FIG. 13 is an enlarged cross-sectional diagram of FIG. 8(A) taken along line XIII-XIII. FIG. 14 is an enlarged diagram of a part encircled by a line XIV in FIG. 7(A).

Figure 7:
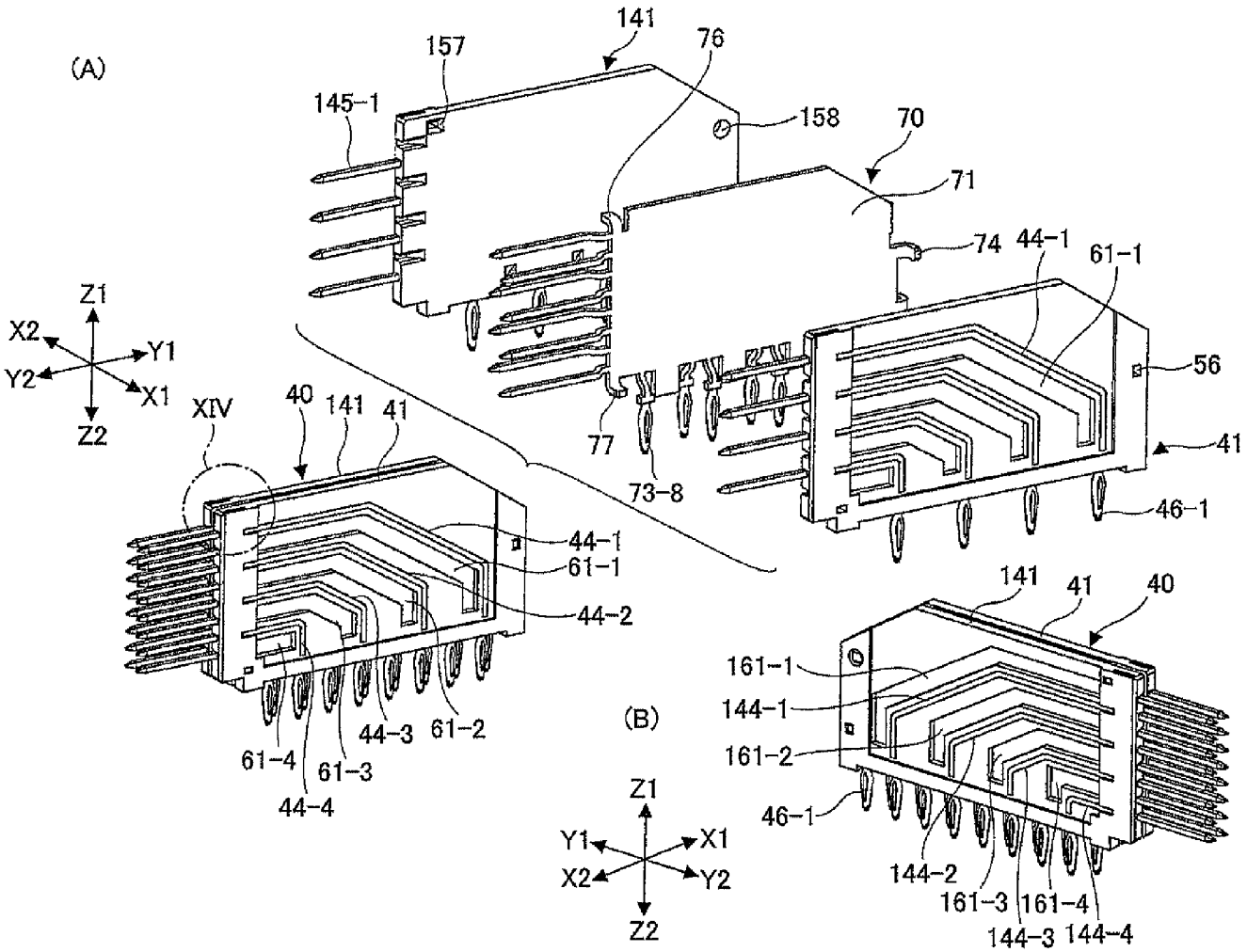
FIG. 7 is a perspective view of a contact module assembly separated into parts.
Figure 8:
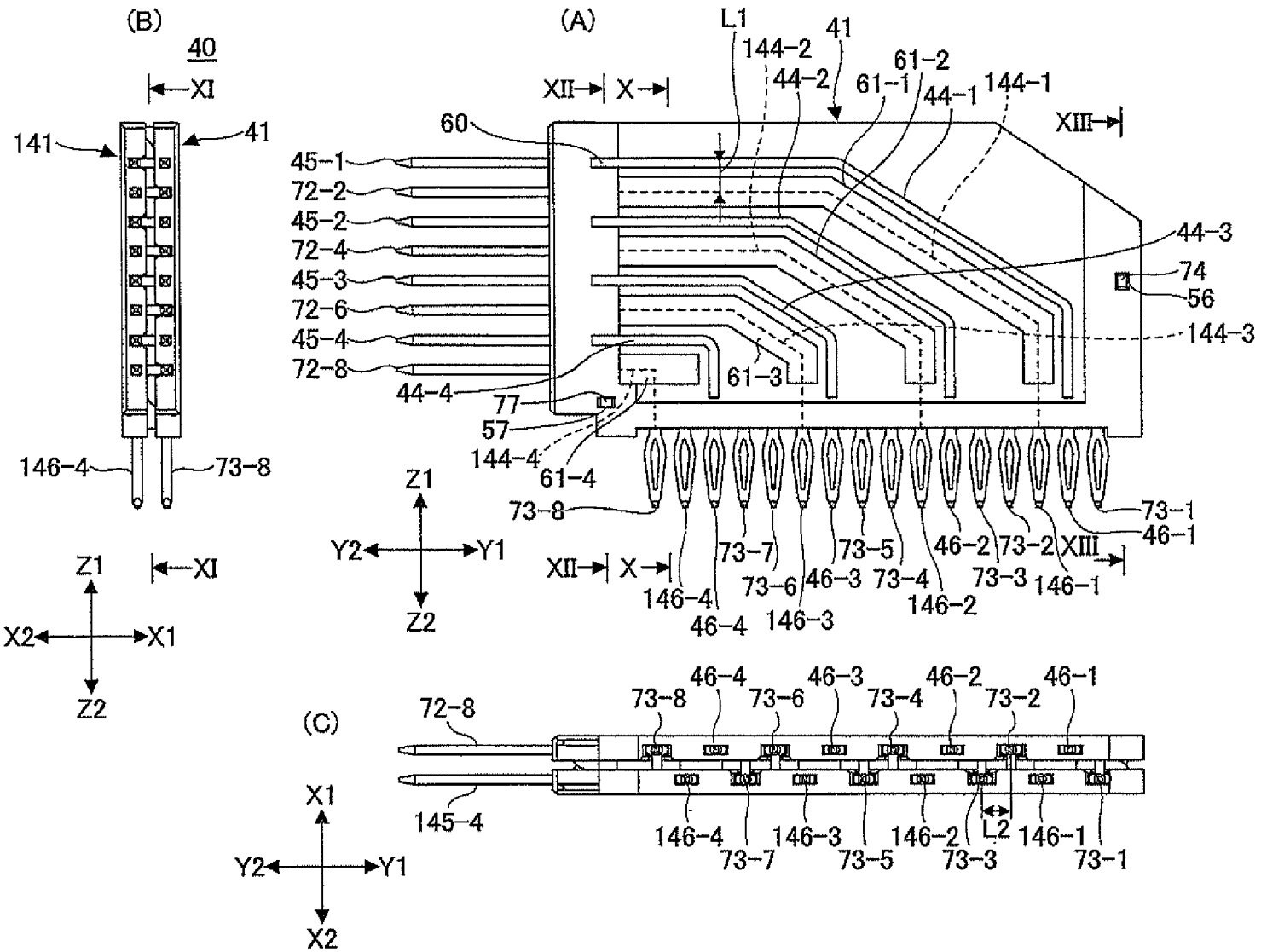
FIG. 8 shows an orthographic projection of a contact module assembly.

As shown in FIG. 7, the contact module assembly 40 includes a ground plate 70 sandwiched between first and second signal contact insert molded modules 41 and 141 as a unit assembly and having a microstrip line on the first signal contact insert molded module 41 side and another microstrip line on the second signal contact insert molded module 141 side.

[Structure of First Signal Contact Insert Molded Module 41]

Figure 16:
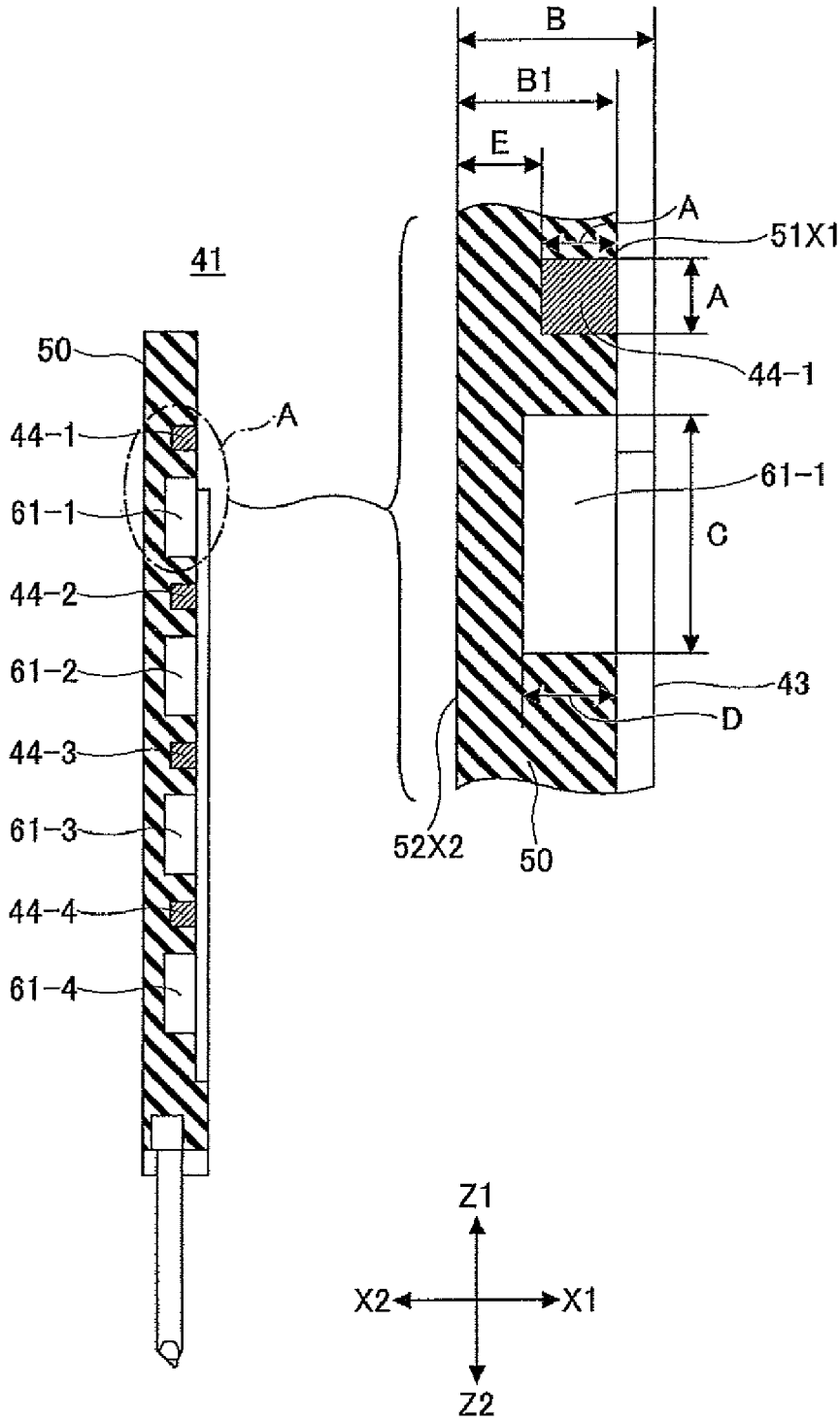
FIG. 16 shows an enlarged view of the signal contact insert molding module in view along a line XVI-XVI FIG. 15(A)
Figure 17:
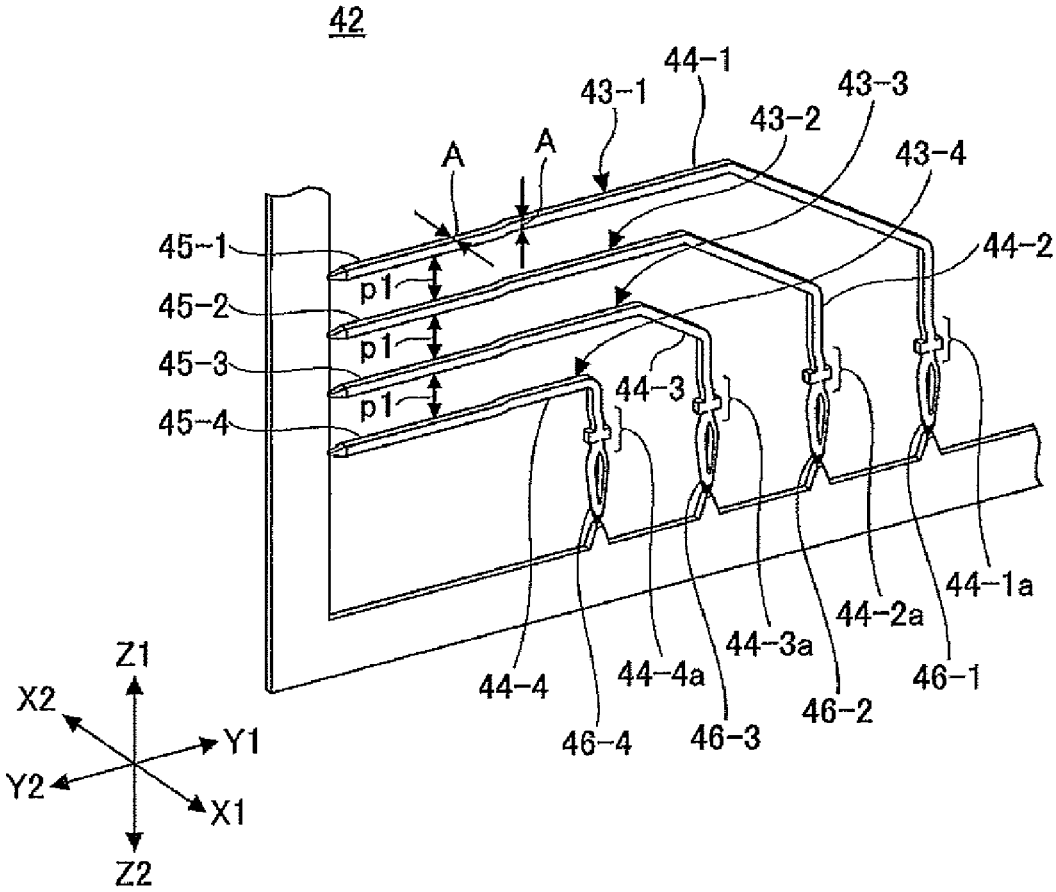
FIG. 17 shows a perspective view of a first signal contact frame.

FIG. 15(A), FIG. 15(B), and FIG. 16 show the first signal contact insert molded module 41 (first module 41). FIG. 16 is an enlarged cross-section drawing at an encircled part of FIG. 15(A) taken along line XVI-XVI. FIG. 17 shows a perspective diagram of a first signal contact frame 42.

For forming the first signal contact insert molded module 41, the first signal contact frame 42 is set on a die (not shown) of a resin molding machine (not shown) and synthetic resin is injected into the die for insert molding so that one side of a first signal contact member 43 is covered with the resin and the another side is exposed. Then the member is removed from the die and finally the contact frame 42 is removed to complete the module 41. The first signal contact insert molded module 41 includes first signal contact members 43-1 through 43-4, and a first resin molded part 50 (see FIG. 16).

For the contact module assembly 40 shown in FIG. 7 and FIG. 8, the first signal contact members 43-1 through 43-4 form striplines of the microstrip line structure and the first resin molded part 50 forms a dielectric substrate of the microstrip line structure.

[First Signal Contact Frame 42]

The first signal contact frame 42 includes first signal contact members 43-1 through 43-4 formed by four lines arranged at a pitch p1, and whose edges are connected to the frame 42, as shown in FIG. 17. The first signal contact members 43-1 through 43-4 include first signal contact bodies 44-1 through 44-4, having approximately L shapes, first signal contact parts 45-1 through 45-4 at an edge Y2 of the first signal contact body 44, and first signal terminal parts 46-1 though 46-4 at an edge Z2 of the first signal contact body 44. The first signal contact bodies 44-1 through 44-4 include approximately square cross sections with sides A. The first signal contact parts 45-1 through 45-4 include conventional pin shapes. The first signal terminal parts 46-1 through 46-4 include press-fit pin shapes.

[First Resin Molded Part 50]

A first resin molded part 50 includes planes 51X1 on the X1 side and 52X2 on the X2 side, with an approximately rectangular shape. The first resin molded part 50 includes a maximum thickness B (corresponding to thicknesses of projection parts 53, 54, and 55), which is approximately twice the thickness of the above side A.

The plane 51X1 includes the projection parts 53, 54, 55 along Y1, Y2, and Z2 directions, respectively. An inner part of the first resin molded part 50, a large part surrounded by the projection parts 53, 54, and 55 includes a concave part having a thickness B1 less than the thickness B above.

As for the plane 51X1 including the above shape, there is the following structure: (1) the first signal contact body 44-1 and the like is placed at about the center of the thickness B, a thickness E from the bottom of the first signal contact body 44-1 and the plane 52X2 is set as a predetermined value, and one side is placed on the same plane with the 51X1 plane; (2) The entire peripheral part of the first signal contact body 44 is surrounded by the projection parts 54 and 55 for both edges; (3) The first signal contact part 45 projects from an approximate thickness center of the first resin molded part 50; (4) The first signal terminal part 46 projects from an approximate thickness center of the first resin molded part 50. Further, the convex shapes of the projection parts 53, 54, and 55 play a role to improve the mechanical strength of the first signal contact insert molded module 41.

For the contact module assembly 40, the thickness E above corresponds with a dimension between the first signal contact body 44 and the ground plate 70, in which the dimension related to a factor that determines the impedance of the first signal contact body 44.

On the projection part 53, a stop through-hole 56 is formed through the projection part 53 at an approximately center height of the first resin molded part 50. On the Z2 end of the projection part 54, a stop through-hole 57 is formed.

The plane 52X2 includes a square stop projection 58 next to the through hole 56 on the Z1 end.

At the Y2 end of the Z1 and Z2 side planes of the first resin molded part 50, a guide projection 59 is formed to fix the housing 11 (see FIG. 15).

[Structure of First Resin Molded Part 50 and First Signal Contact Frame 42]

The first signal contact body 44-1 is fixed on the first resin molded part 50, which surrounds and buries a Z1 side plane 44-1Z1, a Z2 side plane 44-1Z2, and an X2 side plane 44-1X2 of the first signal contact body 44-1, as shown in FIG. 16 as enlarged. The X1 side plane 44-1X1 is exposed from the plane of 51X1. This is to obtain predetermined impedance, which is discussed below. The projection parts 53 and 54 and the entire peripheral part of the first signal contact body 44-1 are surrounded by the resin. Thus, two edges of the first signal contact body 44-1 are surrounded and fixed by resin. In the Y1 side part of the projection part 54, facing a thin part of the first resin molded part 50, there are plural slits 60 formed in the projection part 54. At the slit 60, the first signal contact body 44 is exposed and the exposed part of the first signal contact body 44 is extended to Y2 direction (See FIG. 12 and FIG. 14). Thus, the first signal contact insert molded module 41 is formed to have predetermined mechanical strength and includes extended exposed parts of the first signal contact body 44.

Likewise for the first signal contact body 44-1 above, the other first signal contact bodies 44-2, 44-3, and 44-4 are formed in the first resin molded part 50 and include parts exposed from the X1 side.

On the plane 51X1 of the first resin molded part 50, first grooves 61-1 through 61-4 are formed along the inside of the first signal contact bodies 44-1 through 44-4 (for individual first signal contact bodies 44-1 through 44-4 at the Z2 side and the Y2 side). Individual grooves 61-1 through 61-4 include dimensions of a width C and a depth D. The width C approximately corresponds with the pitch p1 above, being approximately twice the dimension A above. The dimension of the depth D is slightly longer than the dimension A. For the connector 10, the grooves 61-1 through 61-4, next to the plane exposing the first signal contact bodies 44-1 through 44-4 of the contact module assembly 40, are formed to make an air layer (free space) 201-1 and the like shown in FIG. 6.

The first signal contact parts 45-1 through 45-4 project from the edge plane at the Y2 side of the first resin molded part 50 and align with pitch p1, and the first signal terminal parts 46-1 through 46-4 project from the edge plane at the Z2 side and align with a pitch p2.

On the plane 52X2 of the first resin molded part 50, at the Y2 edge plane and at positions adjacent first signal contact parts 45-1 through 45-4 or a close position to the Z2 side compared to the first signal contact parts 45-4, slits 62-1 through 62-4 are formed.

Likewise, a Z2 side edge plane of the plane 52X2 forms slits 63-1 through 63-4 at positions of the first signal terminal parts 46-1 through 46-4 and the Y2 side from the first signal terminal part 46-4. The slits 62-1 through 62-4 are formed to insert the bent part of the root of the ground terminals 73-3 and the like.

[Structure of Second Signal Contact Insert Molded Module 141]

Figure 19:
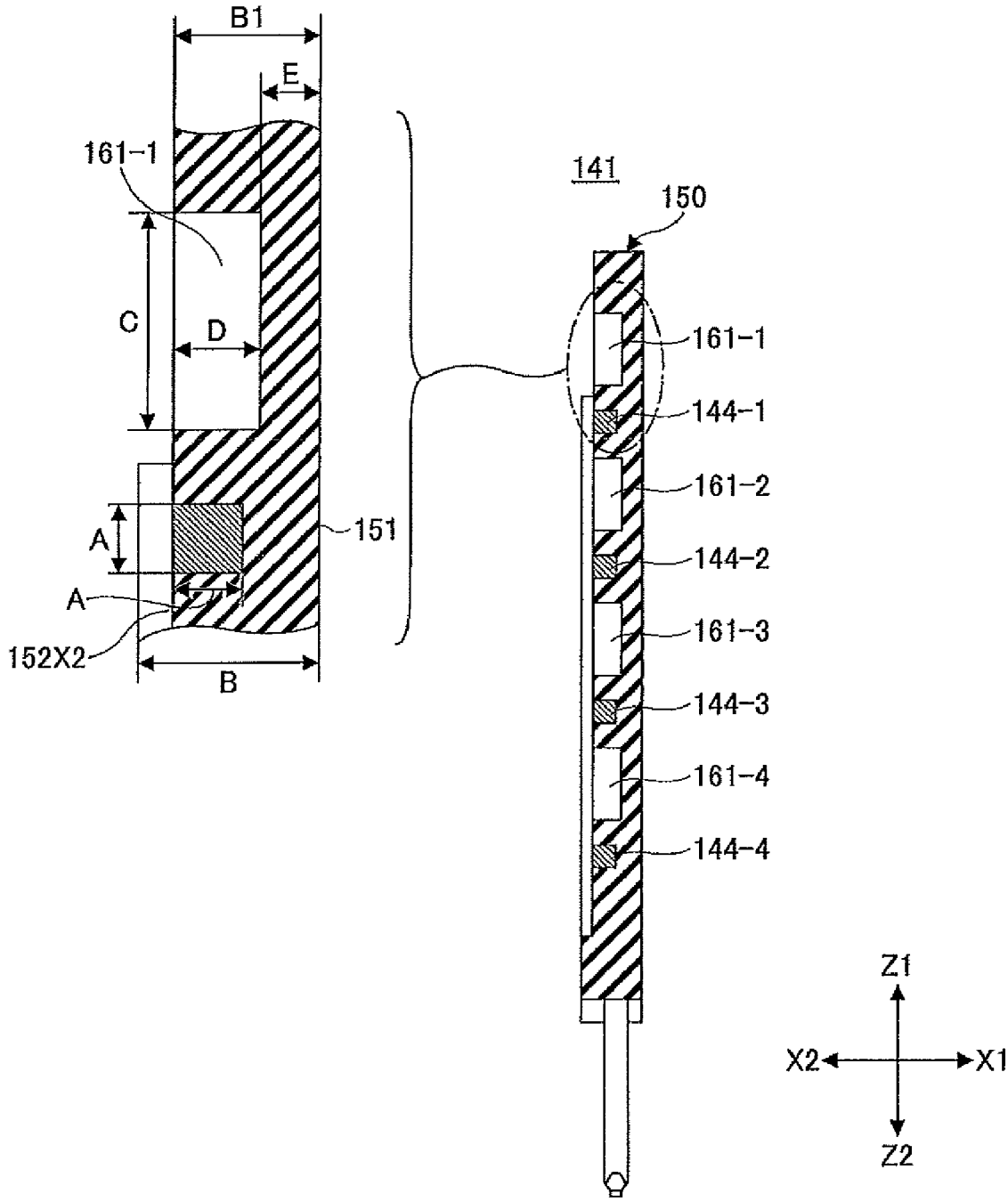
FIG. 19 shows an enlarged cross-sectional view of a second signal contact insert molding module in view along a line XVI-XVI in FIG. 18(A)
Figure 20:
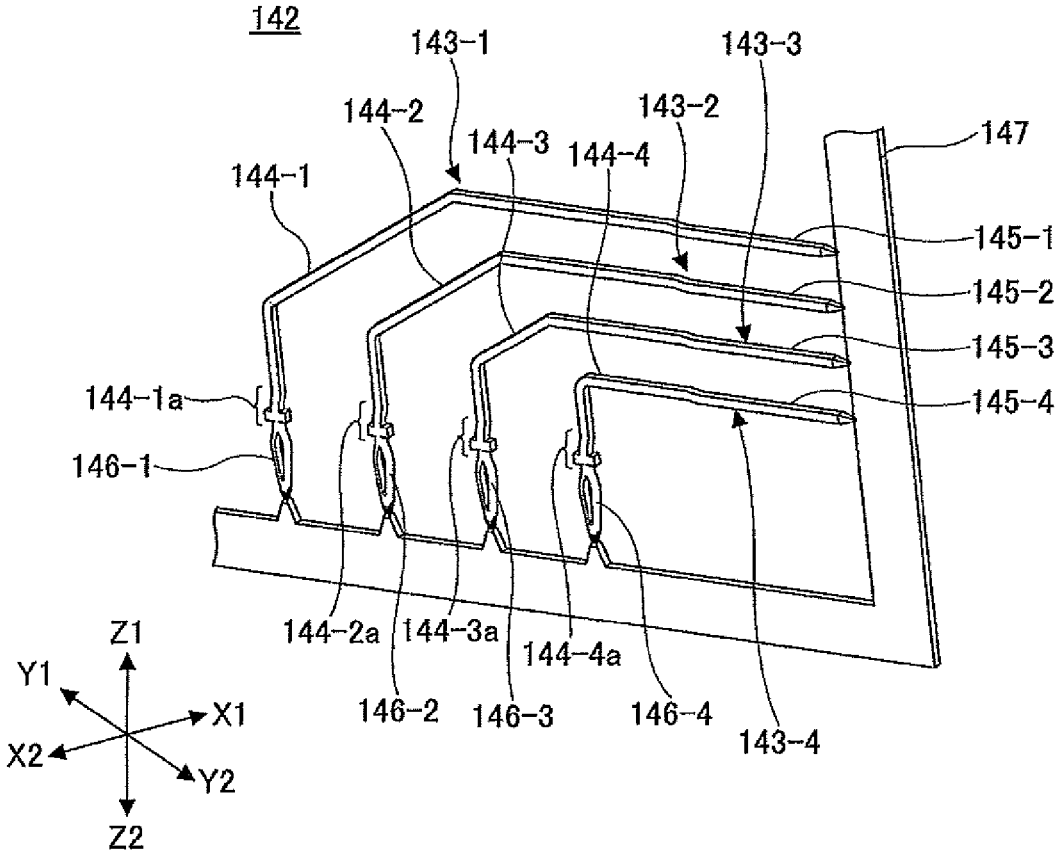
FIG. 20 shows a perspective view of a second signal contact frame.

FIGS. 18(A), (B), and FIG. 19 show the second signal contact insert molded module 141 (second module 141). FIG. 19 shows an enlarged cross-sectional view of the part of FIG. 18(A) taken along line XIX-XIX. FIG. 20 shows a second signal contact frame 142.

The second signal contact insert molded module 141 is formed to have approximately plane symmetry to the first signal contact insert molded module 41 at the plane 51X1, where individual corresponding parts are indicated by part numbers with 100 added.

The second signal contact insert molded module 141 is formed of an insert resin molded module and includes second signal contact members 143-1 through 143-4 and the second resin molded part 150.

The second signal contact bodies 144-1 through 144-4 are exposed from a plane 151X2 at the X2 side of the second contact insert molded module 141.

Figure 9:
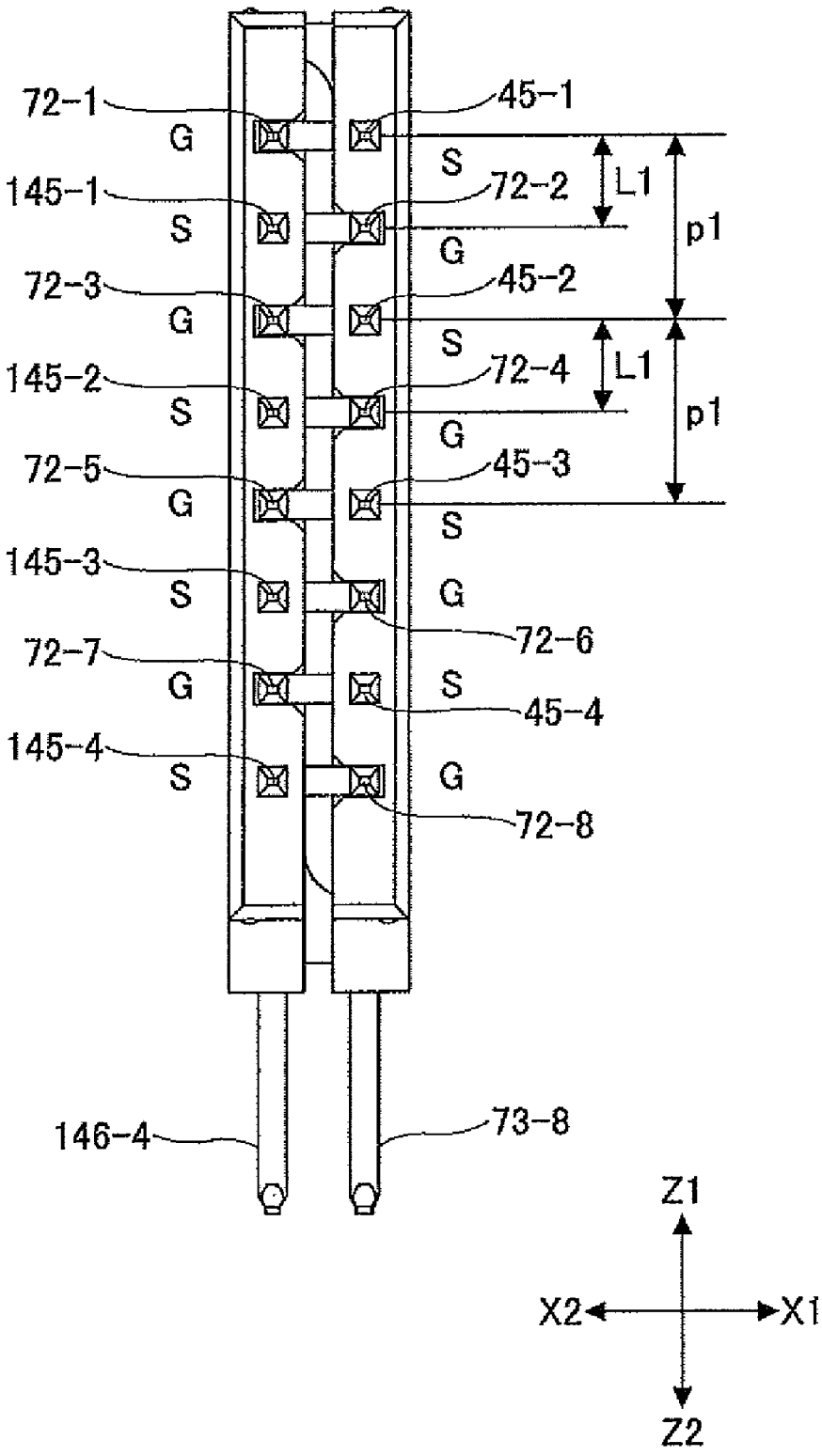
FIG. 9 shows an enlarged view of FIG. 8(B)

When the first signal contact insert molding module 41 and the second signal contact insert molded module 141 are stacked, and when those modules are seen from the X1 side, the second signal contact members 143-1 through 143-4 are formed to shift by a half pitch p1 toward Z2 side compared to the first signal contact members 43-1 through 43-4 (See FIG. 8(A) and FIG. 10). The second signal contact parts 145-1 through 145-4 are formed at positions set off from the first contact parts 45-1 through 45-4 by a half pitch p1 toward Z2 side. This is to embody a staggered structure for the first signal contact parts 45-1 through 45-4 and the second signal contact parts 145-1 through 145-4 in the contact module assembly 40, as shown in FIG. 9. The second signal terminal parts 146-1 through 146-4 are formed at positions set off from the first signal terminal parts 46-1 through 46-4 by a dimension of a quarter pitch p2 toward Y2 side (See FIG. 5 and FIG. 8(C)).

The second grooves 161-1 through 161-4 are formed on the plane 152X2 and along the outside of individual second signal contact bodies 144-1 through 144-4 (at Z1 side and Y1 side to individual second signal contacts 144-1 through 144-4).

The plane 151X1 forms a stop hole 158 to correspond to the stop projection 58.

For the contact module assembly 40 shown in FIG. 7 and FIG. 8, the second signal contact members 143-1 through 143-4 form strip conductors of the microstrip line structure, and the second resin molded part 150 forms a dielectric substrate of the microstrip line structure.

[Shape of Ground Plate 70]

Figure 22:
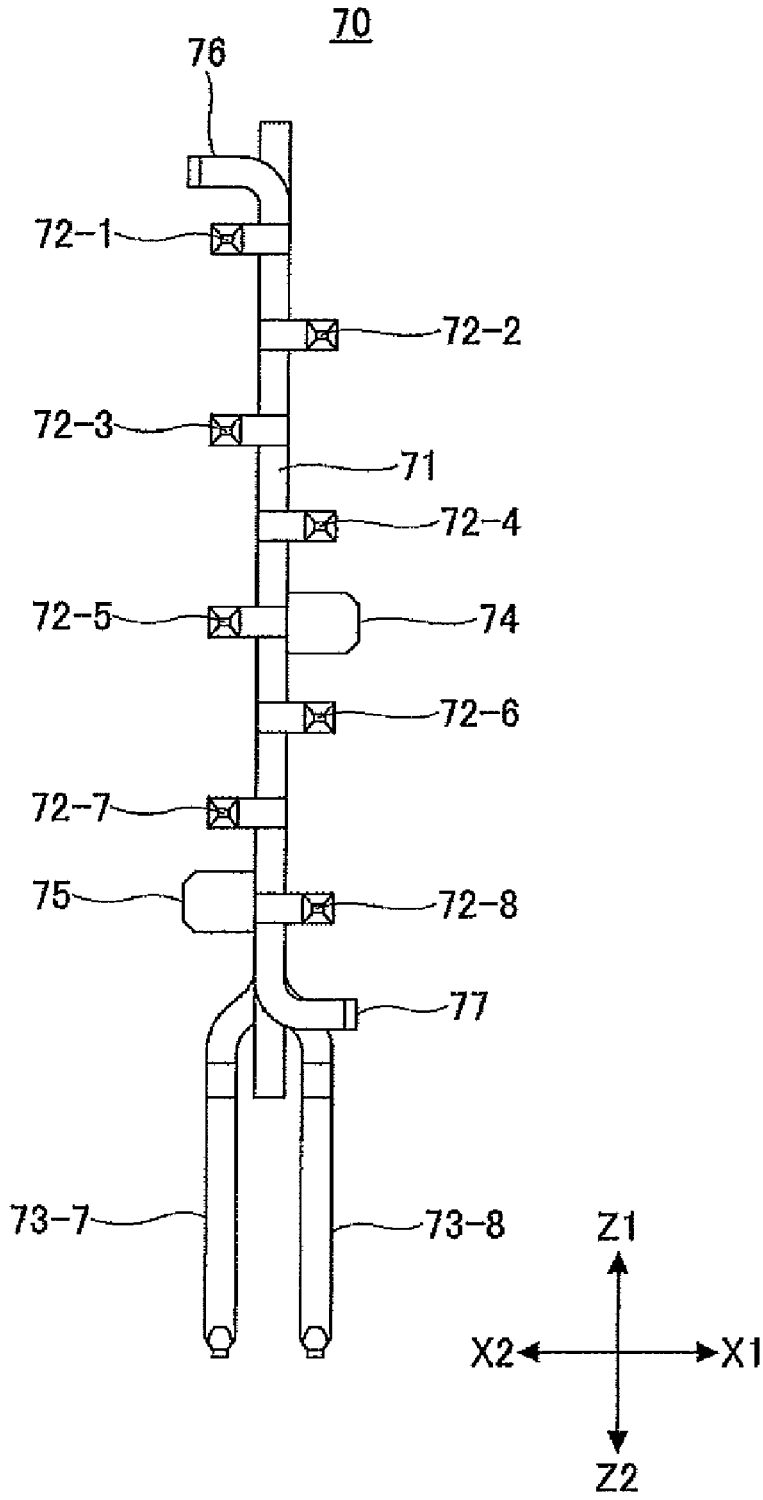
FIG. 22 shows a ground plate in view from Y2 side.
Figure 23:
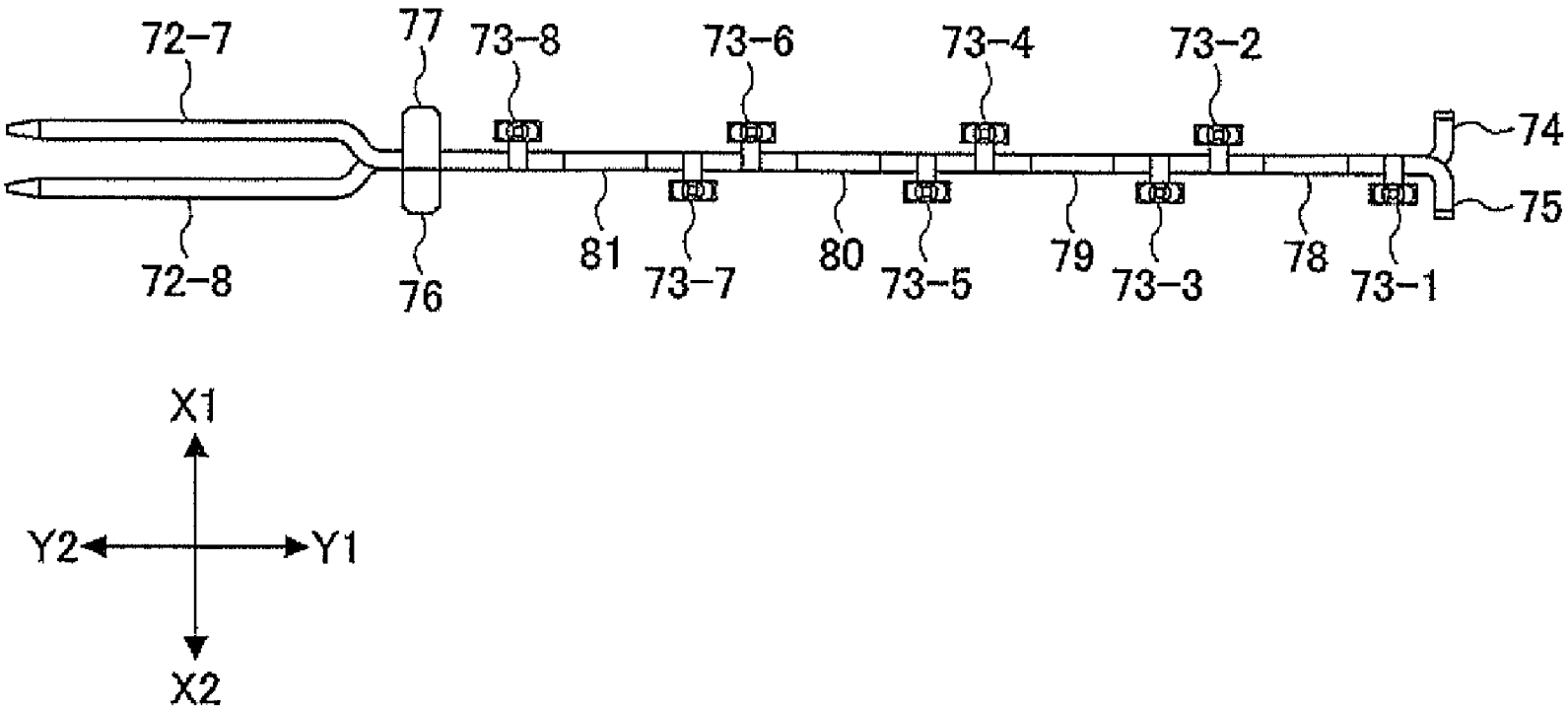
FIG. 23 shows a ground plate in view from Z2 side.

FIGS. 21(A) and (B) show the ground plate 70. FIG. 22 shows a side view of the ground plate 70 from the Y2 direction, and FIG. 23 is a side view of the ground plate 70 from the Z2 direction.

The ground plate 70 forms a ground conductor of the microstrip line structure. As the ground plate 70 is used in common for an X1 side ground conductor of the microstrip line structure and an X2 side ground conductor of the microstrip line structure in the contact module assembly 40, a single ground plate 70 is enough for the contact module assembly 40, as described below.

The ground plate 70 includes a ground plate member 71, plural ground contact members 72 that project from the Y2 side projection part 71Y2 of the ground plate member 71 to the Y2 direction, and plural ground terminals 73 that project from the Z2 side projection part 71Z2 of the ground plate member 71 to the Z2 direction.

The ground plate member 71 has a size and a shape to entirely cover the first and second signal contact bodies 44 and 144, and has almost the same size and shape as the first module 41 and the second module 141 (See FIG. 7). The ground contact member 72 includes a conventional pin shape and the ground terminal member 73 includes a press fit shape.

The ground contact members 72 are aligned with a pitch p3, and individual contact members 72 are bent at each base part to the X2 side and the X1 side respectively, forming a staggered shape as shown in FIG. 6.

The ground terminal members 73 are bent at each base part of the terminal member 73 to the X2 side and the X1 side respectively and form a staggered shape for approximately the X2 side and the X1 side as shown in FIG. 6.

The ground terminal 73 includes ground terminal members 73-1 and 73-8 at corresponding edges in the Y1-Y2 directions and pairs of ground terminal members 73-2, 73-3, 73-4, 73-5, 73-6, and 73-7 in between the two terminal members (see FIG. 21).

Further, a first fixing part 74 is formed by bending an end of the ground plate member 71 to the X1 direction on the Y1 side projection part 71Y1 and a second fixing part 75 is formed by bending another end of the ground plate member 71 to the X2 direction on the Y1 side projection part 71Y1 (see FIG. 21).

The ground plate member 71 forms another second fixing part 76 on a the Y2 side projection part 71Y2 bending to the X2 direction and another first fixing part 77 on the Y2 side projection part 71Y2 bending to the X1 direction.

Further, extended parts 78 through 81 are formed on a projection part 71Z2 extended in the Z2 direction, and the extended parts 78 through 81 are formed between the ground terminal members 73-1 and 73-2, and between the members 73-3 and 73-4, between members 73-5 and 73-6 and between members 73-7 and 73-8, respectively.

[Structure of Contact Module Assembly 40]

The contact module assembly 40 is provided as a unit structure formed by stacking a pair of the first and second signal contact insert molded modules 41 and 141 with the ground plate 70 sandwiched between the modules 41 and 141, as shown in FIG. 7.

The contact module assembly 40 is assembled, for example, where the second module 141 is put with its plane 151X1 facing upward on a work table and the ground plate 70 is pressed onto the second module 141. Then the first module 41 is pressed onto the ground plate 70 having its plane 51X1 facing upward and all of them are tightly pressed. No soldering is necessary. Also, a cleaning treatment, which would be needed if the soldering were performed, is not necessary. Therefore, assembling the contact module assembly 40 is simple.

FIG. 12 shows an assembled configuration of the ground plate 70 and the first and second modules 41 and 141. As shown in FIG. 13, for the ground plate 70 and the second module 141, a second fixing part 75 of the ground plate 70 is pressed to fit into a stop hole 156 and a second fixing part 76 is pressed to fit into the stop hole 157 for fixing their positions.

A bottom part of the ground contact member 72 bent toward the X2 side is fit into a slit 63 and a bottom part of the ground terminal 73 bent toward the X2 side is fit into a slit 63.

The first signal contact insert molded module 41 is assembled with the ground plate 70 of FIG. 11 stacked. As shown in FIG. 13, a first fixing part 74 is pressed to fit into a stop hole 56. A first fixing part 77 is pressed to fit into a stop hole 57, as shown in FIG. 12. Further, a stop projection 58 is pressed into a stop hole 158, so that the first module 41 is positioned and fixed to the ground plate 70 and the second module 141, as shown in FIG. 13. A bottom part of the contact part 72 bent toward the X1 side is pressed to fit into a slit 62, and a bottom part of the contact part 73 bent toward the X1 side is pressed to fit into a slit 62.

Although the bottom parts of the ground contact members 72 and ground terminals 73 are projected toward the plane of the ground plate 71, those projected parts are placed within the slits 62, 162, so that the projected parts are not blocked by the bottom parts of the contact parts 72 and 73. Thus the first module 41, the second module 141 and the ground plate 70 tightly fit together, as shown in FIG. 10.

As shown in FIGS. 12 and 13, the ground plate 70 and the first module 41 are fixed with two stop parts apart from each other, that is, the first fixing part 74 is fixed into the stop hole 56 at the Y1 side and the first fixing part 77 is fixed into the stop hole 57 at the Y2 side.

The ground plate 70 and the second module 141 are fixed with two stop parts apart from each other, in which the second fixing part 75 is fixed into the stop hole 156 at the Y1 side and the second fixing part 76 is fixed into the stop hole 157 at the Y2 side.

The first module 41 and the second module 141 are fixed through the ground plate 70 and fixed by using the stop projection 58 and the stop hole 158.

[Configurations of First Signal Contact Bodies 44-1 Through 44-4, the Second Signal Contact Bodies 144-1 Through 144-4, and Ground Plate 70]

As shown in FIG. 10, the first signal contact bodies 44-1 through 44-4 face on the ground plate 70 via the first resin molded part 50. The first signal contact bodies 44-1 through 44-4 constitute striplines, the first resin molded part 50 constitutes a dielectric substrate, and the ground plate 70 constitutes a ground conductor. The first signal contact bodies 44-1 through 44-4, the first resin molded part 50 and the ground plate 70 constitute a microstrip line structure. The transmission line including the first signal contact bodies 44-1 through 44-4 provide impedance required by the specification of the socket connector 40 (a contact module assembly 40) of FIG. 1 by adjusting the size E (see FIG. 16) and the like accordingly.

Likewise, as shown in FIG. 10, the second signal contact bodies 144-1 through 144-4 face the ground plate 70 via the second resin molded part 150. The second signal contact bodies 144-1 through 144-4 constitute striplines, the second resin part 150 constitutes a dielectric substrate, and the ground plate 70 constitutes a ground conductor. The second signal contact bodies 144-1 through 144-4, the second resin molded part 150 and the ground plate 70 constitute a microstrip line structure. The transmission line including the second signal contact bodies 144-1 through 144-4 provide impedance required by the specification of the socket connector 40 (contact module assembly 40) of FIG. 1 by adjusting the dimension E and the like according.

Therefore, the contact module assembly 40 includes microstrip line structures on both sides X1 and X2, and the individual stripline structures are provided with the ground plate 70 as a common ground conductor.

The backsides of the first signal contact bodies 44-1 through 44-4 and the second signal contact bodies 144 through 144-4, not facing the ground plates 70, are exposed to the air having a dielectric constant 1.00, and an electromagnetic field is formed in a free space over the first resin molded part 50 and the second resin molded part 150. This structure is appropriate to tune the impedance.

[Configurations of First Signal Contact Bodies 44-1 Through 44-4, the Second Signal Contact Bodies 144-1 Through 144-4, First Grooves 61-1 Through 61-4, and Second Grooves 161-1 Through 161-4]

FIG. 8(A) and FIG. 10 show that the first signal contact bodies 44-1 through 44-4 face the X1 side of the contact module assembly 40 and the second signal contact bodies 144-1 through 144-4 face the X2 side of the contact module assembly 40.

The X2 side of the contact module assembly 40 corresponding to the first signal contact bodies 44-1 through 44-4 includes the second grooves 161-1 through 161-4. The X1 side of the contact module assembly 40 corresponding to the second signal contact bodies 144-1 through 144-4 includes the first grooves 61-1 through 61-4.

A view of the contact module assembly 40 from the X1 side, in which the first molded module 41 stacks on the second molded module 141, shows that the signal contact bodies 44-1 through 44-4 and the second signal contact bodies 144-1 through 144-4 are alternately aligned. The backsides of the first signal contact bodies 44-1 through 44-4 are provided with the second grooves 161-1 through 161-4 along the first signal contact bodies 44-1 through 44-4. The first signal contact bodies 44-1 through 44-4 correspond to the second grooves 161-1 through 161-4. Further, the backsides of the first grooves 61-1 through 61-4 are provided with the second signal contact bodies 144-1 through 144-4 along the second grooves 161-1 through 161-4. The first grooves 61-1 through 61-4 correspond to the second signal contact bodies 144-1 through 144-4.

[Arrangement of First Signal Contact Parts 45-1 Through 45-4, Second Signal Contacts 145-1 Through 145-4, and Ground Part 72-1 Through 72-8]

As shown in FIG. 9, the first signal contact parts 45-1 through 45-4 and the second signal contact parts 145-1 through 145-4 are arranged as a first staggered shape and the ground contacts 72-1 through 72-8 are arranged as a second staggered shape opposite to the first staggered shape. The staggered shapes are arranged as two lines.

For the X1 side row, the first signal contact parts 45-1 through 45-4 and the ground contacts 72 line up alternately. For the X2 side row, the second signal contact parts 145-1 through 145-4 and the ground contacts 72 line up alternately.

[Arrangement of First Signal Terminal Parts 46-1 Through 46-4, Second Signal Terminal Parts 146-1 Through 146-4, and Ground Terminal Members 73-1 Through 73-8]

As shown in FIG. 8(C), the first signal terminal parts 46-1 through 46-4 and the second signal terminal parts 146-1 through 146-4 are arranged as a third staggered shape and the ground terminal members 73-1 through 73-8 are arranged as a fourth staggered shape opposite to the third staggered shape. The staggered shapes are arranged as two lines.

For the X1 side row, odd numbered ground terminal members 73-1, 73-3, 73-5 and 73-7 and the first signal terminal parts 46-1 through 46-4 are alternately arranged in a line. For the X2 side row, even numbered ground terminal members 73-2, 73-4, 73-6 and 73-8 and the second signal terminal parts 146-1 through 146-4 are alternately arranged in a line.

[Configuration of First Signal Contact Bodies 44-1 Through 44-4, Second Signal Contact Bodies 144 Through 144-4, Ground Plate 71 and Extended Part 78 Through 81]

As shown in FIG. 7(A) and FIG. 11, the ground plate member 71 has approximately the same size as the first resin molded parts 50 and 150. The space between the first signal contact bodies 44-1 through 44-4 and the second signal contact bodies 144-1 through 144-4 are sealed by the ground plate member 71.

The extended part 78 is located at a position 44-1*a* (see FIG. 11) near the first terminal part 46-1 of the first signal contact 44-1 and located at a position 144-1*a* (see FIG. 11) near the second signal terminal part 146-1 of the second signal contact 144-1. The extended part 78 provides a shield between the positions 44-1*a* and 144-1*a*.

The extended part 79 shields between the positions 44-2*a* and 144-2*a*. The extended part 80 shields between the positions 44-3*a* and 144-3*a*. The extended part 81 provides a shield between the positions 44-4*a* and 144-4*a*.

Thereby, the first signal contact bodies 44-1 through 44-4 are shielded from the second signal contact bodies 144-1 through 144-4 for their entire length.

Further, the first signal contact bodies 44-1 through 44-4 and the second signal contact bodies 144-1 through 144-4 form microstrip line structures by existence of the extended parts 78 through 81 even for parts near the first and second signal terminal parts 46, 146, so that microstrip line structure is provided for their entire length.

[Configuration of Adjacent Contact Module Assembly 40 in Connector 10]

Individual contact module assemblies 40 are inserted into the frame 12 of the housing 11 to reach the end (not shown) of the frame 12, and arranged in direction of X1-X1 facing each other with no separation. The projection parts 59 and 159 of the first and second modules 41, 141 are pressed to touch the ceiling and the bottom of the frame 12. Individual contact module assemblies 40 are fixed with the housing 11 by friction caused between the projection parts 59, 159 and the frame 12.

With reference to FIGS. 4, 5 and 6, assembled configurations of adjacent contact module assemblies 40-1, 40-2 and 40-3 (first, second and third contact module assemblies 40-1, 40-2 and 40-3) are described.

Shield and Impedance of Transmission Line from First Signal Contact Part 45-2 of Second Contact Module Assemblies 40-2 Through First Signal Contact Body 44-2, First Signal Terminal Part 46-2, Second Signal Contact Part 145-2, Second Signal Contact Body 144-2 and Second Signal Terminal Part 146-2

<First Signal Contact Part 45-2 and Second Signal Contact Part 145-2>

As shown in FIG. 4, the first signal contact part 45-2 is located between the ground contact 72-2 at the Z1 side, the ground contact 72-4 at the Z2 side, the ground contact (the ground contact of the third contact module assembly 40-3) at the right side and the ground contact 72-3 at the X2 side.

The second signal contact part 145-2 is located between the ground contact 72-3 at the Z1 side, the ground contact 72-5 at the Z2 side, the ground contact 72-4 (the ground contact of the second contact module assembly 40-2) on the right side and the ground contact of the first contact module assembly 40-1 on the left, X2 side.

Likewise, the other first signal contact parts 45-1, 45-3, 45-4, and the other second signal contact parts 145-1, 145-3, and 145-4 are located in the same manner as the signal contact parts 45-2 and 145-2 described above.

Therefore, the first signal contact parts 45-1 through 45-4 and the second signal contact parts 145-1 through 145-4 are individually arranged so that the ground contacts are located between the adjacent signal contacts which are thus shielded.

<First Signal Contact Body 44-2>

As shown in FIG. 5 and FIG. 6, the first signal contact body 44-2 is shielded from the second signal contact bodies 144-1 and 144-2 by the ground plate 70 and the extended part 79 for its entire length.

The exposed part of the first signal contact body 44-2 faces the groove 161-2 of the third contact module assembly 40-3, and the exposed part of the first signal contact body 44-2 faces an air layer 200-2. Thereby, the impedance of the first signal contact body 44-2 is provided to be higher than a case where the first signal contact body 44-2 is entirely surrounded by resin, so that the predetermined impedance is obtained.

The first signal contact body 44-2 forms a stripline conductor, the first resin molded part 50 forms a dielectric substrate, and the ground plate 70 forms a ground conductor. The first signal contact body 44-2, the first resin molded part 50 and the ground plate 70 form a microstrip line structure where an electromagnetic field is formed crossing over the first resin molded part 50 and the free space.

Likewise for the first signal contact body 44-2 as described above, the other first signal contact bodies 44-1, 44-3 and 44-4 are shielded from the second signal contact bodies 144 of the same contact module assembly 40 by the ground plate 70 and the extended parts 78, 80, and 81 for its entire length. Further, the exposed parts of the first signal contact bodies 44-1, 44-3 and 44-4 individually face the grooves 161-1, 161-3 and 161-4 of the third contact module assembly 40-3. Both sides of the exposed parts of the first signal contact bodies 44-1, 44-3, 44-4 have air layers 200-1, 200-3 and 200-4, so that a predetermined impedance is obtained. Likewise the other first signal contact bodies 44-1, 44-3 and 44-4 form microstrip lines in the same manner described above.

<Second Signal Contact Body 144-2>

As shown in FIG. 5 and FIG. 6, the second signal contact body 144-2 is shielded from the first signal contact bodies 44-2 and 44-3 by the ground plate 70 and the extended part 79 for their entire length.

The exposed part of the second signal contact body 144-2 faces the groove 61-1 of the first contact module assembly 40-1, and the exposed part of the second signal contact body 144-2 faces an air layer 201-2. Thereby, the impedance of the second signal contact body 144-2 is made to be higher than a case where the first signal contact body 144-2 is entirely surrounded by resin, so that the predetermined impedance is obtained.

Further, the second signal contact body 144-2 forms a stripline conductor, the second resin molded part 150 forms a dielectric substrate, and the ground plate 70 forms a ground conductor. The second signal contact body 144-2, the second resin molded part 150 and the ground plate 70 form a microstrip line structure where an electromagnetic field is formed crossing over the second resin molded part 150 and the free space.

Likewise for the second signal contact body 144-2 as described above, the other second signal contact bodies 144-1, 144-3 and 144-4 are shielded from the first signal contact bodies 44 of the same contact module assembly 40 by the ground plate 70 and the extended parts 78, 80, and 81 for their entire length. Further, the exposed parts of the second signal contact bodies 144-1, 144-3 and 144-4 individually face the grooves 61-1, 61-3 and 61-4 of the first contact module assembly 40-1. Both sides of the exposed parts of the second signal contact bodies 144-1, 144-3, 144-4 have air layers 201-1, 201-3 and 201-4, so that a predetermined impedance is obtained.

Likewise the other second signal contact bodies 144-1, 144-3 and 144-4 form microstrip lines by the same manner described above.

<First Signal Terminal Parts 46-1 Through 46-4 and Second Signal Terminal Parts 146-1 Through 146-4>

As shown in FIG. 5, the first signal terminal parts 46-1 through 46-4 and the second signal terminal parts 146-1 through 146-4 are arranged in a staggered shape and located between the ground terminals 73-1 through 73-8 which are aligned in an approximately staggered arrangement.

Modified Example

Figure 24:
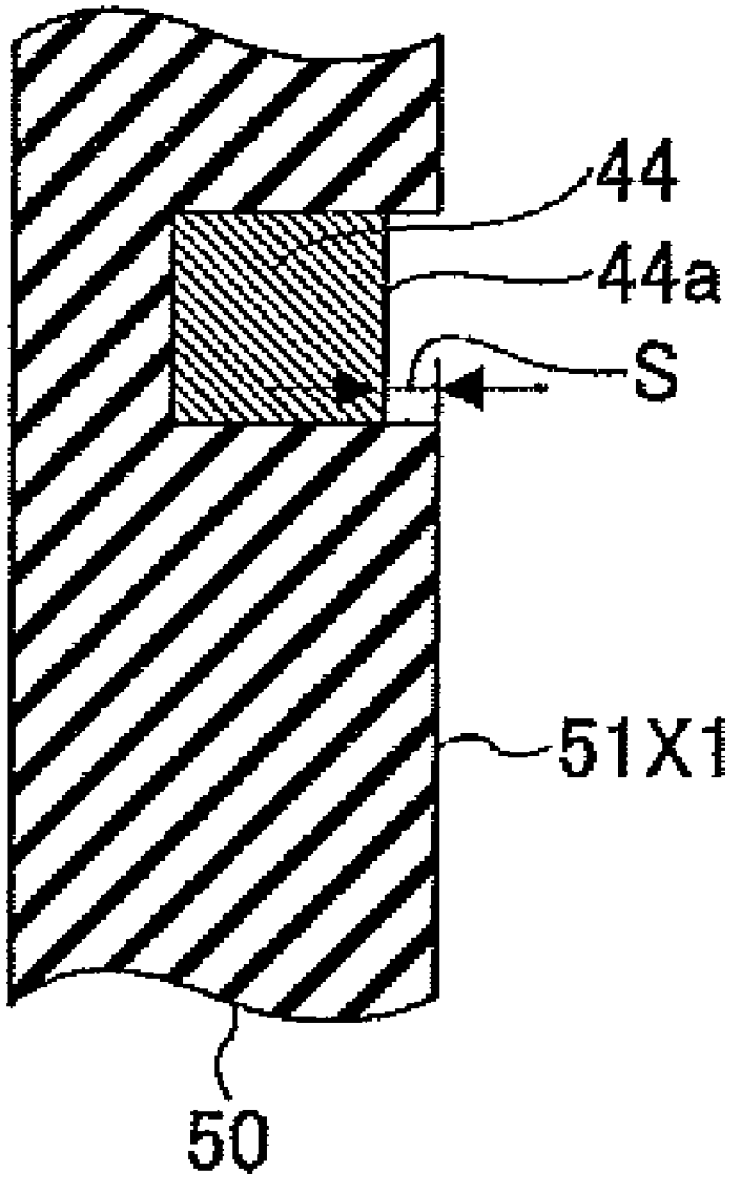
FIG. 24 shows a modified example of a signal contact insert molding module.

As shown in FIG. 24, for the first signal contact body 44, the exposed part 44*a* may be formed as a concavity by a dimension S from the plane 51X1 of the first resin molded part 50. Likewise, the second signal contact body 144 may be formed as a concavity from the plane of the second resin molded part 150

Although the invention has been described with respect to specific embodiment for a complete and clear disclosure, the appended claims are not to be thus limited but are to be construed as embodying all modifications and alternative constructions that may occur to one skilled in the art that fairly fall within the basic teachings herein set forth.

This patent application is based on Japanese Priority Patent Application No. 2008-048199 filed on Feb. 28, 2008, the entire contents of which are hereby incorporated by reference.

What is claimed is:

1. A connector comprising:

a housing; and a plurality of contact module assemblies in the housing, wherein each contact module assembly includes a first signal contact module where a first signal contact body is inserted in a first resin molded part, a second signal contact module where a second signal contact body is inserted in a second resin molded part, and a ground plate, wherein the ground plate is sandwiched between the first signal contact module and the second signal contact module, so that a microstrip line structure is formed, and wherein, in the niicrostrip line structure, the first signal contact body and the second signal contact body form a stripline conductor, the first resin molded part and the second resin molded part form a dielectric board, and the ground plate forms a common ground conductor.

2. The connector as claimed in claim 1, wherein a portion of the first signal contact body is exposed from the first resin molded part, and a portion of the second signal contact body of the second contact member is exposed from the second resin molded part.

3. The connector as claimed in claim 1, wherein each of the first resin molded part and the second resin molded part includes an inner part and a projection part provided on a periphery of the inner part, the inner part is thinner than the projection part, each portion of the first and second contact body is exposed from the thinner part, and the projection part is entirely surrounded by resin.

4. The connector as claimed in claim 3, wherein a part of the projection part includes slit parts arranged to correspond to the first and second signal contact bodies for exposing the first and second signal contact bodies.

5. The connector as claimed in claim 1, wherein the ground plate includes a first fixing part to fix the first resin molded part and a second fixing part to fix the second resin molded part.

6. The connector as claimed in claim 5, wherein the ground plate includes a ground plate member, the first fixing part and the second stop are formed by bending end parts of the ground plate member.

7. The connector as claimed in claim 6, wherein at least one end of the ground plate member is bent toward the first resin molded part and at least one end of the ground plate member is bent toward the second resin molded part.

8. The connector as claimed in claim 1, wherein the first resin molded part includes a projection and a hole; and the second resin molded part includes another projection and another hole;

wherein the projection of the first resin molded part is locked into the another hole of the second resin molded part, the another projection of the second resin molded part is locked into the hole of the first resin molded part.

9. The connector as claimed in claim 1, wherein the first signal contact body and the second signal contact body are arranged in staggered manner when the first signal contact module and the second signal contact module are stacked, the first resin molded part includes a first groove formed along the first signal contact body, and the second resin molded part includes a second groove formed along the second signal contact body, wherein the first signal contact body is arranged to correspond to the second groove, the first groove is arranged to correspond to the second signal contact body when the first signal contact module and the second signal contact module are stacked.

10. The connector as claimed in claim 9, wherein a first contact module assembly has a first side and a second side;

a second contact module assembly is arranged next to the first side of the first contact module assembly; and a third contact module assembly is arranged next to the second side of the first contact module assembly;

wherein the first signal contact body of the first contact module assembly corresponds to the second groove of the second contact module assembly, and the second signal contact body of the first contact module assembly corresponds to the first groove of the third contact module assembly.

11. The connector as claimed in claim 1, wherein the ground contact parts are bent alternately toward the first resin molded part and the second resin molded part; and the ground terminal parts are bent alternately toward the first resin molded part and the second resin molded part;

wherein the first resin molded part includes a plurality of slits to respectively fit a part of the ground contact parts bent toward the first resin molded part, another plurality of slits to respectively fit a part of the ground terminal parts bent toward the first resin molded part, the second resin molded part includes a plurality of slits to respectively fit a part of the ground contact parts bent toward the second resin molded part, and another plurality of slits to respectively fit the ground terminal parts bent toward the second resin molded part.

* * * * *